US008804973B2

(12) United States Patent
Hirohata et al.

(10) Patent No.: US 8,804,973 B2
(45) Date of Patent: Aug. 12, 2014

(54) SIGNAL CLUSTERING APPARATUS

(75) Inventors: Makoto Hirohata, Tokyo (JP); Kazunori Imoto, Kanagawa-ken (JP); Hisashi Aoki, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 305 days.

(21) Appl. No.: 13/423,631

(22) Filed: Mar. 19, 2012

(65) Prior Publication Data

US 2012/0237042 A1 Sep. 20, 2012

Related U.S. Application Data

(63) Continuation of application No. PCT/JP2009/004778, filed on Sep. 19, 2009.

(51) Int. Cl.
*H04R 29/00* (2006.01)

(52) U.S. Cl.
USPC ..... 381/56; 361/58; 361/59; 361/96; 361/300; 361/303; 704/245; 704/246; 704/247

(58) Field of Classification Search
USPC ..... 381/56, 58, 59, 96, 300, 303; 704/245, 704/246, 247
See application file for complete search history.

(56) References Cited

U.S. PATENT DOCUMENTS

| | | | |
|---|---|---|---|
| 6,434,520 | B1 | 8/2002 | Kanevsky et al. |
| 2006/0058998 | A1 | 3/2006 | Yamamoto et al. |
| 2008/0215324 | A1 | 9/2008 | Hirohata |

FOREIGN PATENT DOCUMENTS

| | | |
|---|---|---|
| JP | 03-231297 | 10/1991 |
| JP | 2008-175955 | 7/2008 |

OTHER PUBLICATIONS

Y. Moh et al., "Towards Domain Independent Speaker Clustering", IEEE-ICASSP 2003, vol. 2, pp. 85-88.*
International Search Report for PCT/JP2009/004778 dated Dec. 28, 2009.
Y. Akita et al., "Unsupervised Speaker Indexing Using Anchor Models and Automatic Transcription of Discussions", ISCA 8th European Conference Speech Communication and Technology (euro Speech), Sep. 2003, pp. 2985-2988.
E. Scheirer et al., "Construction and Evaluation of a Robust Multifeature Speech/Music Discriminator", IEEE International Conference on Acoustic Speech, and Signal Processing, Apr. 1997, pp. 1331-1334.

* cited by examiner

*Primary Examiner* — Vivian Chin
*Assistant Examiner* — Paul Kim
(74) *Attorney, Agent, or Firm* — Nixon & Vanderhye, P.C.

(57) ABSTRACT

In an example signal clustering apparatus, a feature of a signal is divided into segments. A first feature vector of each segment is calculated, the first feature vector having has a plurality of elements corresponding to each reference model. A value of an element attenuates when a feature of the segment shifts from a center of a distribution of the reference model corresponding to the element. A similarity between two reference models is calculated. A second feature vector of each segment is calculated, the second feature vector having a plurality of elements corresponding to each reference model. A value of an element is a weighted sum and segments of second feature vectors of which the plurality of elements are similar values are clustered to one class.

4 Claims, 20 Drawing Sheets

CLUSTERING RESULT OUTPUTTED FROM THE CLUSTERING UNIT

| START TIME (sec) | COMPLETION TIME (sec) | SCENE ID |
|---|---|---|
| 0 | 1 | A |
| 1 | 2 | A |
| 2 | 3 | A |
| 3 | 4 | B |
| 4 | 5 | A |
| 5 | 6 | A |
| 6 | 7 | A |
| 7 | 8 | B |
| 8 | 9 | B |
| 9 | 10 | B |

103

DISPLAY EXAMPLE OF TIME INFORMATION OF EACH SCENE BY CHARACTERS

| SCENE INFORMATION | SEGMENTATION INFORMATION | START TIME (sec) | COMPLETION TIME (sec) |
|---|---|---|---|
| SCENE A | SEGMENT 1 | 0 | 3 |
| | SEGMENT 3 | 4 | 7 |
| SCENE B | SEGMENT 2 | 3 | 4 |
| | SEGMENT 4 | 7 | 10 |

DISPLAY EXAMPLE OF SCENE INFORMATION OF EACH TIME BY CHARACTERS

| SEGMENTATION INFORMATION | START TIME (sec) | COMPLETION TIME (sec) | SCENE INFORMATION |
|---|---|---|---|
| SEGMENT 1 | 0 | 3 | SCENE A |
| SEGMENT 2 | 3 | 4 | SCENE B |
| SEGMENT 3 | 4 | 7 | SCENE A |
| SEGMENT 4 | 7 | 10 | SCENE B |

DISPLAY EXAMPLE OF SCENE INFORMATION OF EACH TIME BY PICTURE (SUPPOSITION OF TIME BAR)

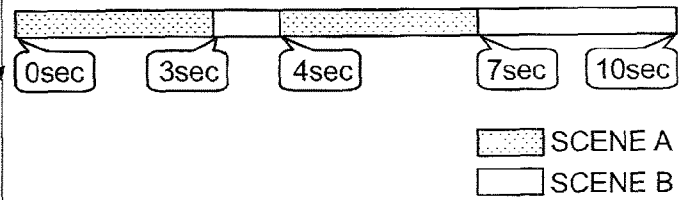

FIG. 18

SIGNAL CLUSTERING APPARATUS

CROSS-REFERENCE TO RELATED APPLICATION

This application is a continuation application of International Application No. PCT/JP2009/004778, filed on Sep. 19, 2009; the entire contents of which are incorporated herein by reference.

FIELD

Embodiments described herein relate generally to a signal clustering apparatus.

BACKGROUND

As to signal clustering technique, an acoustic signal is finely divided into each segment, and segments having similar feature are clustered as the same class. By using this technique, in a meeting or a broadcast program including a plurality of participates, an acoustic signal (acquired from the meeting or the broadcast program) is clustered for each speaker. Furthermore, in a video (such as a home video), by distinguishing a background sound at a place where the video is captured, the acoustic signal is clustered for each event or each scene. Hereinafter, one unit including an utterance of the speaker or a specific event is called "a scene".

As to a conventional technique, in order to characterize each segment divided from an acoustic signal, a plurality of reference models is generated from the acoustic signal to be processed. Then, an observation probability (Hereinafter, it is called "a likelihood") between each segment and each reference model is calculated. In this case, the reference model is represented by an acoustic feature. Especially, segments (divided signals) belonging to the same scene have a high likelihood for a specific reference model, i.e., a similar feature.

In this conventional technique, when reference models are generated from an acoustic signal comprising scenes having various durations, the number of reference models (representing each scene) depends on a duration of the scene. In other words, a plurality of reference models is often generated based on the scene. Briefly, when duration of a scene is longer, the number of reference models representing the scene becomes larger. Accordingly, if a segment does not have a high likelihood for all reference models representing a specific scene, the segment cannot be clustered to the specific scene. Furthermore, by clustering segments to a scene having a long duration (represented by the large number of reference models), information of another scene having a short duration (represented by the small number of reference models) becomes unnoticeable. As a result, detection of another scene having the short duration is often missed.

BRIEF DESCRIPTION OF THE DRAWINGS

FIG. 18 is operation examples of a clustering result display unit in FIG. 16.

DETAILED DESCRIPTION

Figure 1:
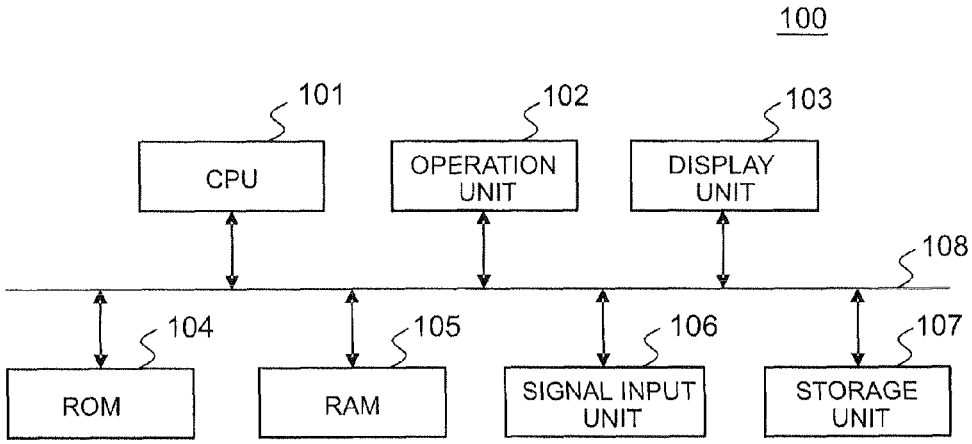
FIG. 1 is a block diagram of entire component of a signal clustering apparatus according to a first embodiment.

According to one embodiment, a signal clustering apparatus includes a feature extraction unit, a division unit, a reference model acquisition unit, a first feature vector calculation unit, an inter-models similarity calculation unit, a second feature vector calculation unit, and a clustering unit. The feature extraction unit is configured to extract a feature having a distribution from a signal. The division unit is configured to divide the feature into segments by a predetermined duration. The reference model acquisition unit is configured to acquire a plurality of reference models. Each reference model represents a specific feature having a distribution. The first feature vector calculation unit is configured to calculate a first feature vector of each segment by comparing each segment with the plurality of reference models. The first feature vector has a plurality of elements corresponding to each reference model. A value of an element attenuates when a divided feature of the segment shifts from a center of the distribution of the specific feature of the reference model corresponding to the element. The inter-models similarity calculation unit is configured to calculate a similarity between two reference models as all pairs selected from the plurality of reference models. The second feature vector calculation unit is configured to calculate a second feature vector of each segment. The second feature vector has a plurality of elements corresponding to each reference model. A value of an element of the second feature vector is a weighted sum by multiplying each element of the first feature vector of the same segment by the similarity between each reference model and the reference model corresponding to the element. The clustering unit is configured to cluster segments corresponding to second feature vectors of which the plurality of elements are similar values to one class.

Hereinafter, further embodiments will be described with reference to the accompanying drawings. In the drawings, same sign represents the same or similar part.

The First Embodiment

FIG. 1 is a block diagram of entire component of a signal clustering apparatus 100 according to the first embodiment. As shown in FIG. 1, the signal clustering apparatus 100 includes a CPU (Central Processing Unit) 101, an operation unit 102, a display unit 103, a ROM (Read Only Memory) 104, a RAM (Random Access Memory) 105, a signal input unit 106, and a storage unit 107. Each unit is connected via a bus 108.

By using a predetermined area of the RAM 105 as a working area, the CPU 101 executes various processing in cooperation with various control programs previously stored in the ROM 104. Furthermore, the CPU 101 generally controls operation of each unit composing the signal clustering apparatus 100.

By equipping various kinds of input keys, the operation unit 102 accepts information operatively inputted from a user as an input signal, and outputs the input signal to the CPU 101.

For example, the display unit 103 comprises a display such as a LCD (Liquid Crystal Display), and displays various information based on a display signal from the CPU 101. Moreover, the display unit 103 may form a touch panel with the operation unit 102 as one body.

The ROM 104 unrewritably stores program (to control the signal clustering apparatus 100) and various kinds of set information. The RAM 105 is a storage means such as a SDRAM, and functions as a working area of the CPU 101, i.e., a buffer. The signal input unit 106 converts an acoustic signal (from a microphone not shown in Fig.) or a video signal (from a camera not shown in Fig.) to an electric signal, and outputs the electric signal as numerical data such as PCM (Pulse Code Modulation) to the CPU 101.

The storage unit 107 includes a memory medium magnetically or optically storable, and stores signals acquired via the signal input unit 106 or signals inputted from the outside via a communication unit or an I/F (Interface) not shown in Fig. Furthermore, the storage unit 107 stores clustering result information (explained afterwards) of an acoustic signal by the signal clustering apparatus.

Figure 2:
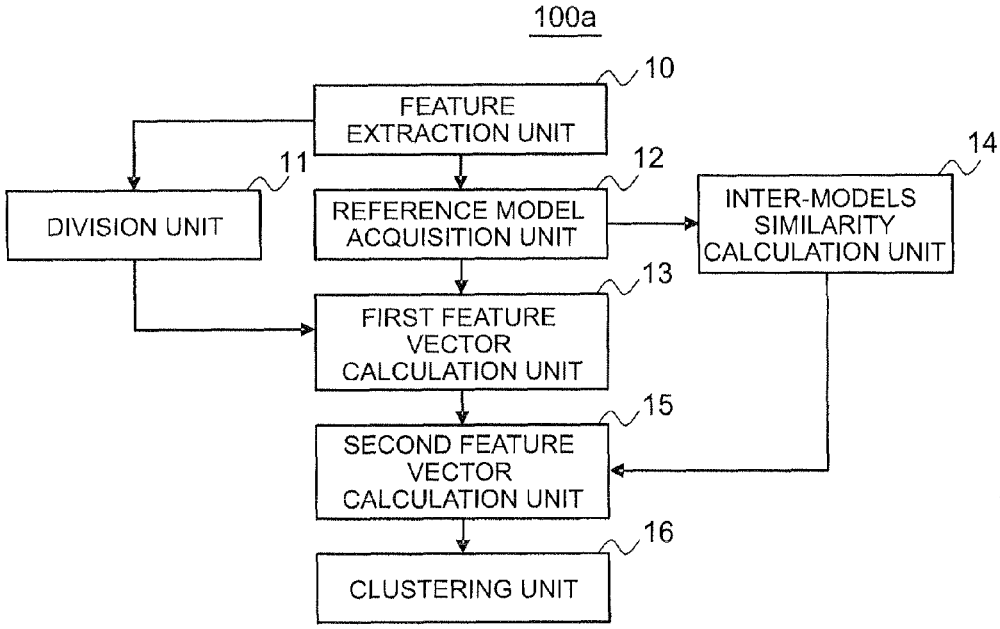
FIG. 2 is a block diagram of functional component of the signal clustering apparatus according to the first embodiment.

FIG. 2 is a block diagram of functional component of the signal clustering apparatus 100*a* according to the first embodiment. As shown in FIG. 2, the signal clustering apparatus 100 includes a feature extraction unit 10, a division unit 11, a reference model acquisition unit 12, a first feature vector calculation unit 13, an inter-models similarity calculation unit 14, a second feature vector calculation unit 15, and a clustering unit 16.

The feature extraction unit 10 extracts an acoustic feature every predetermined duration C1 from the acoustic signal (inputted via the signal input unit 106), and outputs the acoustic feature to the division unit 11. Furthermore, the feature extraction unit 10 outputs the acoustic feature to the reference model acquisition unit 13 based on operation of the reference model acquisition unit 12 (explained afterwards).

The feature extraction unit 10 may uses a method disclosed in "Unsupervised Speaker Indexing using Anchor Models and Automatic Transcription of Discussions", Y. Akita, ISCA $8^{th}$ European Conf. Speech Communication and Technology (Euro Speech), September 2003. Concretely, the feature extraction unit 10 extracts a cepstrum feature such as LPC cepstrum or MFCC every predetermined duration C1 from the acoustic signal having a predetermined duration C2. Moreover, durations C1 and C2 has relationship as "C1<C2". For example, C1 is 10.0 msec, and C2 is 25.0 msec.

The feature extraction unit 10 may use a method disclosed in "Construction and Evaluation of a Robust Multi feature Speech/Music Discriminator", E. Scheirer, IEEE International Conference on Acoustic Speech, and Signal Processing, April 1997. Concretely, the feature extraction unit 10 calculates a spectral variance or the number of zero-cross having duration C2 every predetermined duration C1, and extracts an acoustic feature based on the spectral variance or the number of zero-cross. Furthermore, the feature extraction unit 10 may extract a distribution of the spectral variance or the number of zero-cross in predetermined duration C2' as the acoustic feature.

As mentioned-above, the feature extraction unit 10 extracts the acoustic feature from the acoustic signal. However, a signal and a feature extracted therefrom are not limited to the acoustic signal and the acoustic feature. For example, an image feature may be extracted from a video signal inputted via a camera. Furthermore, as to a plurality of photographs each having an acoustic signal, by extracting the acoustic signal from each photograph and connecting them, a continuous acoustic signal may be inputted via the signal input unit 106.

The division unit 11 divides the acoustic feature (inputted from the feature extraction unit 10) into each segment having an arbitrary duration according to segmentation information indicated. Furthermore, the division unit 11 outputs an acoustic feature of each segment and time information (start time and completion time) thereof to the first feature vector calculation unit 13.

The reference model acquisition unit 12 acquires a plurality of reference (acoustic) models represented by the acoustic feature (extracted by the feature extraction unit 10). Furthermore, the reference model acquisition unit 12 outputs information of the reference models to the first feature vector calculation unit 13 and the inter-models similarity calculation unit 14. Each reference model does not have scene information (condition 1). The condition 1 means that it cannot be decided whether arbitrary two reference models represent the same scene. Furthermore, at least one scene is represented by a plurality of reference models (condition 2). If the conditions 1 and 2 are satisfied, reference models previously stored in the ROM 104 may be acquired without operation of the reference model acquisition unit 12 (explained afterwards).

In this case, the scene means a cluster to which acoustic signals having similar feature belongs. The cluster is, for example, distinction among speakers in a meeting or a broadcast program, distinction among background noises at a place where a home video is captured, or distinction of events such as details thereof. Briefly, the scene is a cluster meaningfully collected.

By using the acoustic feature of each segment (inputted from the division unit 11) and a plurality of reference models (inputted from the reference model acquisition unit 12), the first feature vector calculation unit 13 calculates a first feature vector peculiar to each segment. Furthermore, the first feature vector calculation unit 13 outputs the first feature vector of each segment and time information thereof to the second feature vector calculation unit 15.

By using the plurality of reference models (inputted from the reference model acquisition unit 12), the inter-models similarity calculation unit 14 calculates a similarity between two reference models as all pairs in the plurality of reference models. Furthermore, the inter-models similarity calculation unit 14 outputs the similarity of all pairs to the second feature vector calculation unit 15.

By using the first feature vector of each segment (inputted from the first feature vector calculation unit 13) and the similarity (inputted from the inter-models similarity calculation unit 14), the second feature vector calculation unit 15 calculates a second feature vector peculiar to each segment. Furthermore, the second feature vector calculation unit 15 outputs the second feature vector of each segment and time information thereof to the clustering unit 16.

Among the second feature vector of each segment (inputted from the second feature vector calculation unit 15), the clustering unit 16 clusters a plurality of second feature vectors having similar feature as one class. Furthermore, the clustering unit 16 assigns the same ID (class number) to segments corresponding to the plurality of second feature vectors belonging to the one class.

Figure 3:
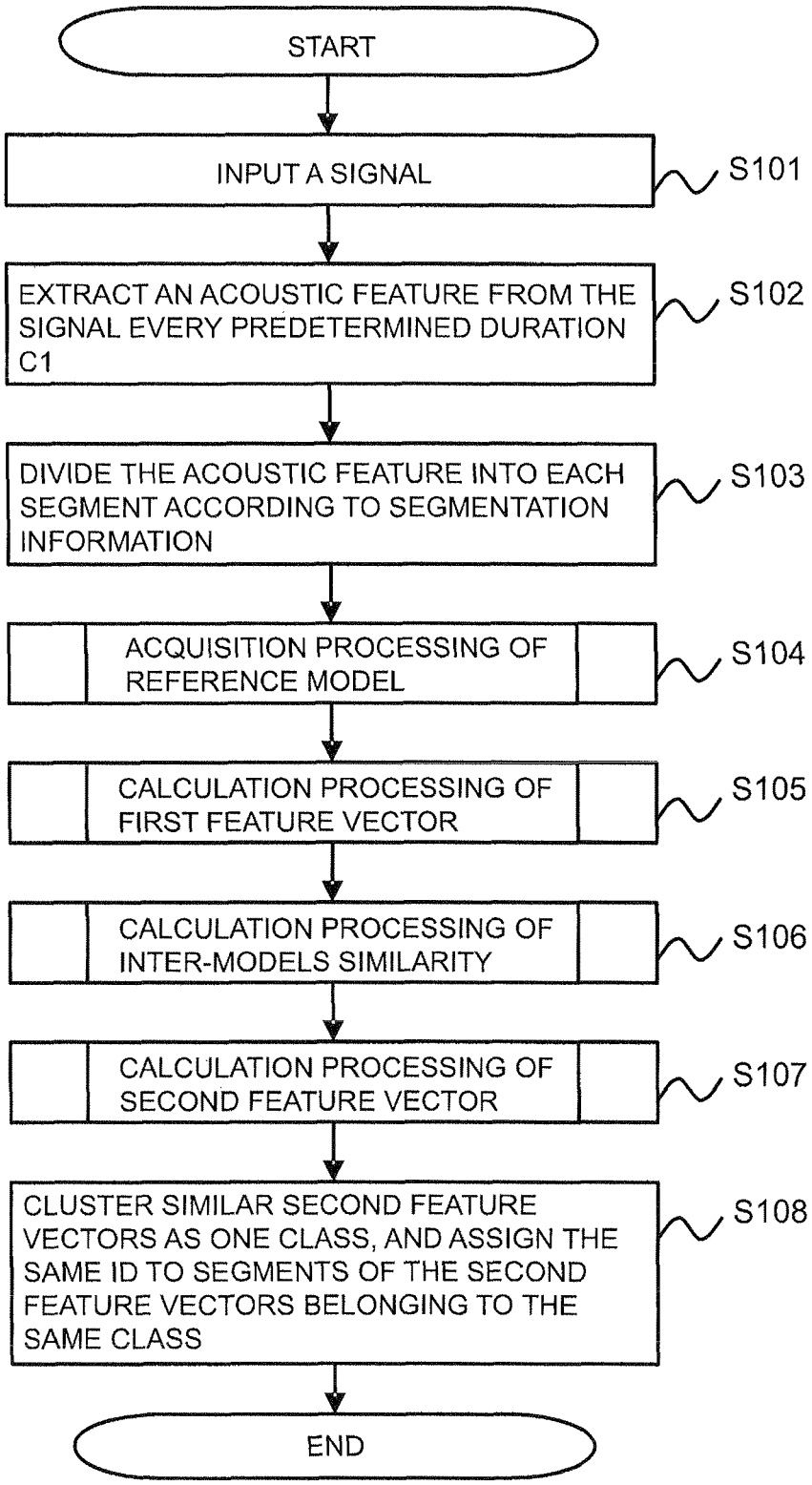
FIG. 3 is a flow chart of processing of the signal clustering apparatus according to the first embodiment.

Next, operation of the signal clustering apparatus of the first embodiment is explained. FIG. 3 is a flow chart of processing of the signal clustering apparatus 100*a*. Hereinafter, by referring to FIG. 3 and FIGS. 4A and 4B (O1~O7), signal clustering processing of the first embodiment is explained.

First, when a signal is inputted via the signal input unit 106 (S101 in FIG. 3), the feature extraction unit 10 extracts an acoustic feature every predetermined duration C1 from the signal (S102 in FIG. 3). The feature extraction unit 10 outputs the acoustic feature to the division unit 11 and the reference model acquisition unit 12.

Continually, the division unit 11 divides the acoustic feature into each segment according to segmentation information previously indicated (S103 in FIG. 3). The division unit 11 outputs an (divided) acoustic feature of each segment to the first feature vector calculation unit 13.

In this case, the acoustic feature clustered for each segment may represent a plurality of acoustic features included in the segment. Furthermore, the acoustic feature may represent an average of a plurality of acoustic features. Furthermore, the segmentation information may be information that duration of each segment is set to C3 (predetermined duration). Moreover, this duration C3 has relationship "C2<C3". For example, C3 is set to 1 sec. In operation example of FIG. 4A, processing timing is shown at T1, T2, T3 and T4, and the acoustic feature extracted at the timing is −9.0, −3.1, 1.0 and 8.0 respectively (Refer to O1 in FIG. 4A).

Furthermore, the segmentation information may be acquired by another processing, and each segment need not have the equal duration. For example, a method disclosed in "Speaker Change Detection and Speaker Clustering Using VQ Distortion Measure" by Seiichi NAKAGAWA and Kazumasa MORI, in pp. 1645-1655 of Institute of Electronics, Information and Communication Engineers, Vol. J85-D-II No. 11, November 2002 may be used. Concretely, by detecting time when the feature changes largely (such as speaker change time), a segment divided by this time may be given as the segmentation information. Furthermore, by detecting a soundless segment from the acoustic signal, a sounded segment divided by the soundless segment may be given as the segmentation information.

Figure 4A:
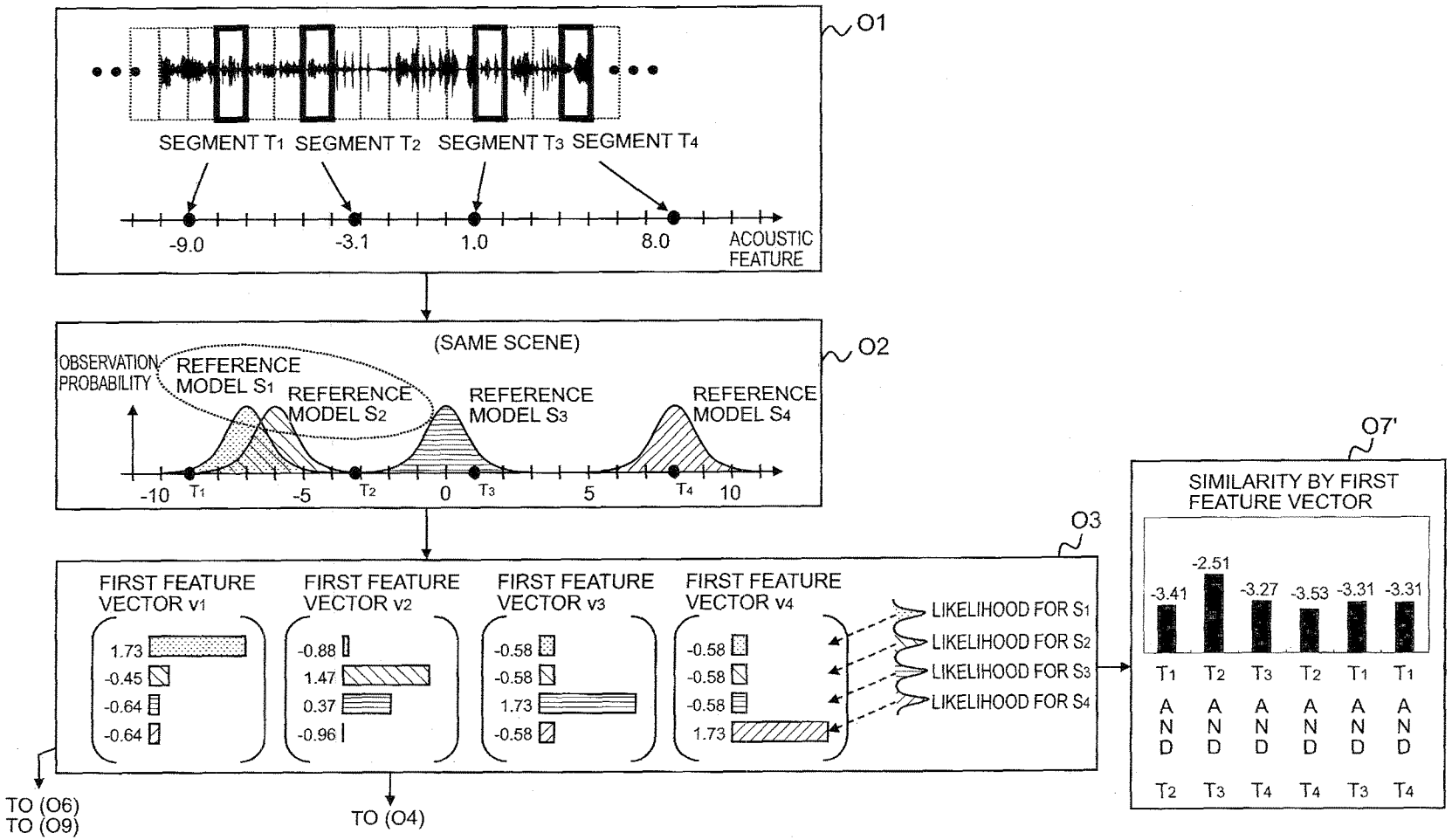
FIGS. 4A, 4B and 4C are operation examples of the signal clustering apparatus according to the first and second embodiments.

Moreover, in operation example of FIG. 4A, four reference models $s_1$, $s_2$, $s_3$ and $s_4$ are acquired, an average thereof is −7, −6, 0 and 8 respectively, and a distribution thereof is 1. Furthermore, reference models s1 and s1 represent the same scene (Refer to O2 in FIG. 4A).

Continually, by using the acoustic feature extracted every predetermined duration C1 at S102, the reference model acquisition unit 12 executes reference mode-acquisition processing, and acquires reference models (S104 in FIG. 3).

Figure 5:
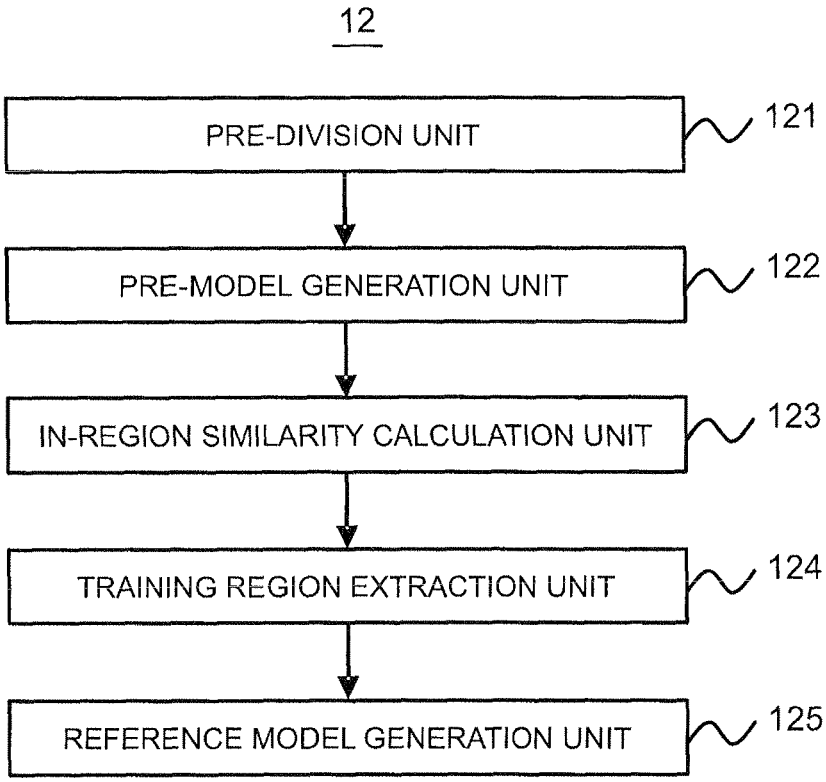
FIG. 5 is a functional component of a reference model acquisition unit in FIG. 2.

Next, detail operation of the reference model acquisition unit 12 is explained by referring to FIG. 5. FIG. 5 is a block diagram of functional component of the reference model acquisition unit 12. As shown in FIG. 5, the reference model acquisition unit 12 includes a pre-division unit 121, a pre-model generation unit 122, an in-region similarity calculation unit 123, a training region extraction unit 124, and a reference model generation unit 125.

The pre-division unit 121 divides the acoustic feature (inputted from the feature extraction unit 10) into each pre-segment having predetermined duration. In this case, the pre-division unit 121 sets duration of each pre-segment to C4 (predetermined duration), and outputs an acoustic feature of each pre-segment and time information thereof to the pre-model generation unit 122. By setting the duration C4 (For example, 2.0 sec) shorter than a general utterance time (by one speaker) or one scene, the pre-segment had better be composed by an acoustic feature of one speaker or one scene only.

Whenever an acoustic feature of each pre-segment is inputted from the pre-division unit 121, the pre-model generation unit 122 generates a pre-model (acoustic model) from the acoustic feature. The pre-model generation unit 122 outputs the outputs the pre-model and information (acoustic information and time information) peculiar to a pre-segment thereof to the in-region similarity calculation unit 123. Under a condition of the predetermined duration C4, sufficient statistic amount to generate the model is not acquired occasionally. Accordingly, the pre-model had better be generated by using VQ (Vector Quantization) code book.

The in-region similarity calculation unit 123 sets a plurality of pre-segments (continually inputted from the pre-model generation unit 122) as one region in order, and calculates a similarity of each region based on pre-models of pre-segments included in the region. Furthermore, the in-region similarity calculation unit 123 outputs the similarity and information of pre-segments included in the region to the training region extraction unit 124.

The training region extraction unit 124 extracts the region having the similarity (inputted from the in-region similarity calculation unit 123) larger than a threshold as a training region. Furthermore, the training region calculation unit 124 outputs an acoustic feature and time information corresponding to the training region to the reference model generation unit 125. This training region-extraction processing (by the in-region similarity calculation unit 123 and the training region extraction unit 124) can be executed as a method disclosed in JP-A No. 2008-175955.

The reference model generation unit 125 generates a reference model of each training region based on the acoustic feature of each training region (inputted from the training region extraction unit 125). When an acoustic feature of a segment to be clustered is compared with the reference model, a likelihood of the acoustic feature is higher if the acoustic feature is nearer a center of distribution of an acoustic feature used for generating the reference model. Conversely, the likelihood of the acoustic feature quickly attenuates if the acoustic feature is apart (shifts) from a center of distribution of an acoustic feature used for generating the reference model. This characteristic is called "a constraint of the reference model". As to the constraint, when the likelihood is added with weight to other likelihood, strength and weakness is largely assigned to addition degree. For example, a model based on normal distribution such as GMM (Gaussian Mixture Model) satisfies a constraint of this model. Moreover, assume that reference models stored in the ROM 104 satisfies a constraint thereof.

The reference model acquisition unit 12 outputs reference models (acquired from the reference model generation unit 125) to the first feature vector calculation unit 13 and the inter-models similarity calculation unit 14.

Next, by using the reference models (acquired at S104) and the acoustic feature of each segment (divided at S103), the first feature vector calculation unit 13 executes first feature vector-calculation processing, and calculates a first feature vector of each segment (S105 in FIG. 3).

Figure 6:
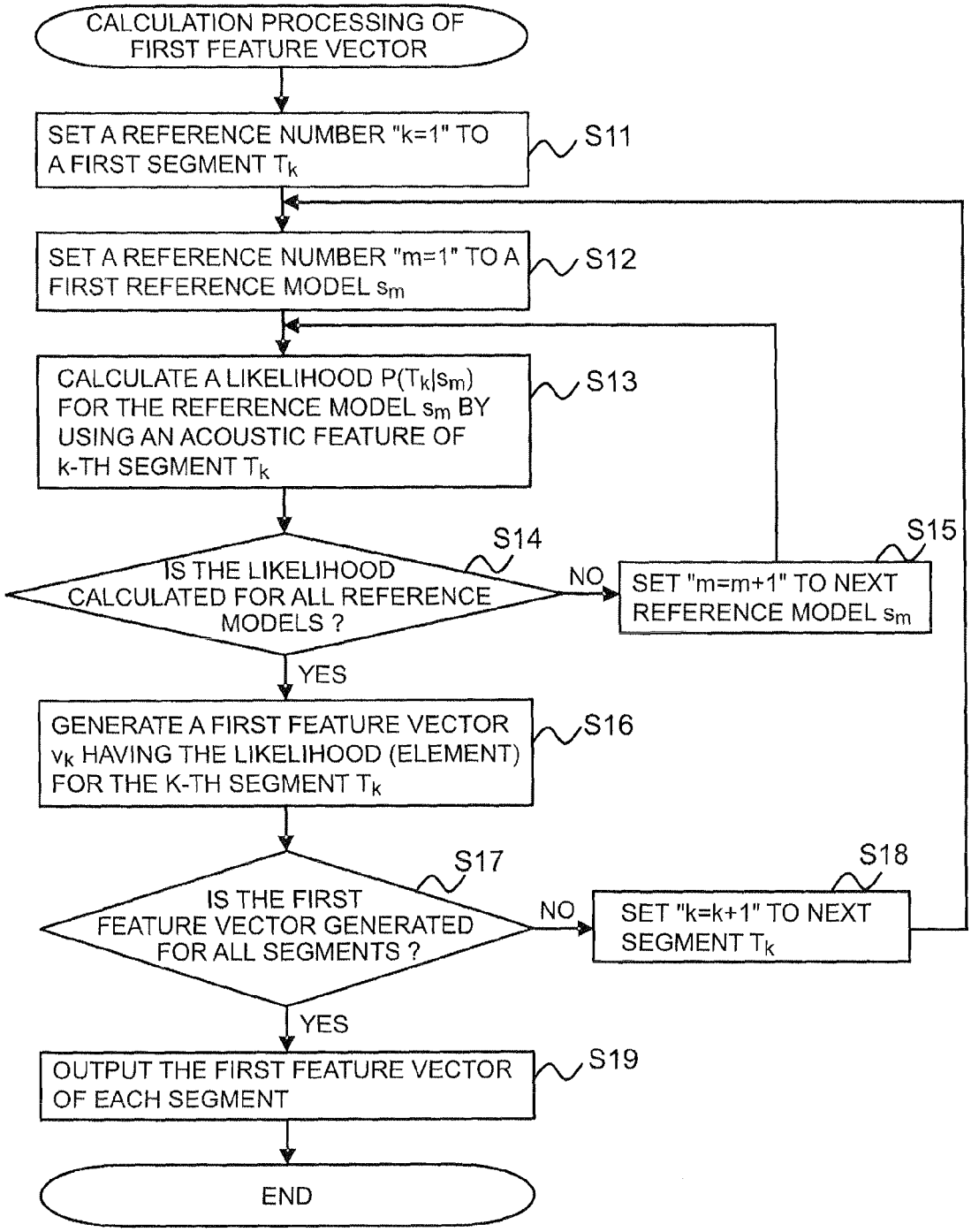
FIG. 6 is a flow chart of processing of a first feature vector calculation unit in FIG. 2.

Here, detail operation of the first feature vector calculation unit 13 is explained by referring to FIG. 6. FIG. 6 is a flow chart of processing of the first feature vector calculation unit 13. First, the first feature vector calculation unit 13 sets a reference number "k=1" to a first segment $T_k$ (S11). Next, the first feature vector calculation unit 13 sets a reference number "m=1" to a first reference model $s_m$ (S12).

Next, by using the acoustic feature of k-th segment $T_k$, the first feature vector calculation unit 13 calculates a likelihood $P(T_k|s_m)$ for m-th reference model $s_m$ (S13). In this case, the likelihood for the reference model $s_m$ is calculated by using an equation (1).

$$P(T_k \mid s_m) = \frac{1}{I_k}\sum_{i=1}^{I_k}\sum_{m=1}^{N_m} c_{mn}\frac{1}{\sqrt{(2\pi)^{dim}|U_{mn}|}}\exp\left\{-\frac{1}{2}(f_i-u_{mn})^T U_{mn}(f_i-u_{mn})\right\} \quad (1)$$

Moreover, in the equation (1), "dim" is the number of dimension of the acoustic feature, "$l_k$" is the number of acoustic features in segment $T_k$, "$f_i$" is i-th acoustic feature of segment $T_k$, "$N_m$" is the number of mixture of reference model $s_m$, and "$C_{mn}$, $u_{mn}$, $U_{mn}$" are a mixture weight coefficient of a mixture element "n", an averaged vector, and a diagonal covariance matrix of the reference model $s_m$ respectively. Furthermore, a logarithm of the likelihood may be used at post processing.

Continually, the first feature vector calculation unit 13 decides whether likelihood-calculation of S13 is performed for all reference models inputted from the reference model acquisition unit 12 (S14). In this case, if the likelihood-calculation is not performed for at least one reference model (No at S14), by setting the reference number "m=m+1", a next reference model $s_m$ is set as a processing target (S15), and processing is returned to S13.

On the other hand, if the likelihood-calculation is performed for all reference models (Yes at S14), a vector having the likelihood (as each element) corresponding each reference model is generated as a first feature vector $v_k$ of k-th segment $T_k$ by using an equation (2) (S16). In the equation (2), the number of reference models is M. Moreover, modification processing such as normalization of elements of the first feature vector $v_k$ may be executed to the first feature vector $v_k$. In operation example of FIG. 4A, after the likelihood is calculated by the equation (2), by using an average and a standard deviation of elements in each first feature vector, each element of the first feature vector is normalized so that the average is "0" and the deviation is "1" (Refer to operation example O3 in FIG. 4A).

$$v_k = \begin{pmatrix} P(T_k \mid s_1) \\ P(T_k \mid s_2) \\ \vdots \\ P(T_k \mid s_M) \end{pmatrix} \quad (2)$$

Next, the first feature vector calculation unit 13 decides whether the first feature vector $v_k$ is generated for all segments (S17). In this case, if the first feature vector $v_k$ is not generated for at least one segment $T_k$ (No at S17), by setting the reference number "k=k+1", a next segment $T_k$ is set as a processing target (S18), and processing is returned to S12.

On the other hand, if the first feature vector $v_k$ is generated for all segments (Yes at S17), the first feature vector of each segment and time information thereof are outputted to the second feature vector calculation unit 15 (S19), and processing is completed. In this way, the first feature vector calculation unit 13 outputs first feature vectors to the second feature vector calculation unit 15.

Next, the inter-models similarity calculation unit 14 executes calculation processing of inter-models similarity by using reference models acquired at S104, and calculates a similarity between two reference models as all pairs in the all reference models (S106 in FIG. 3).

Figure 7:
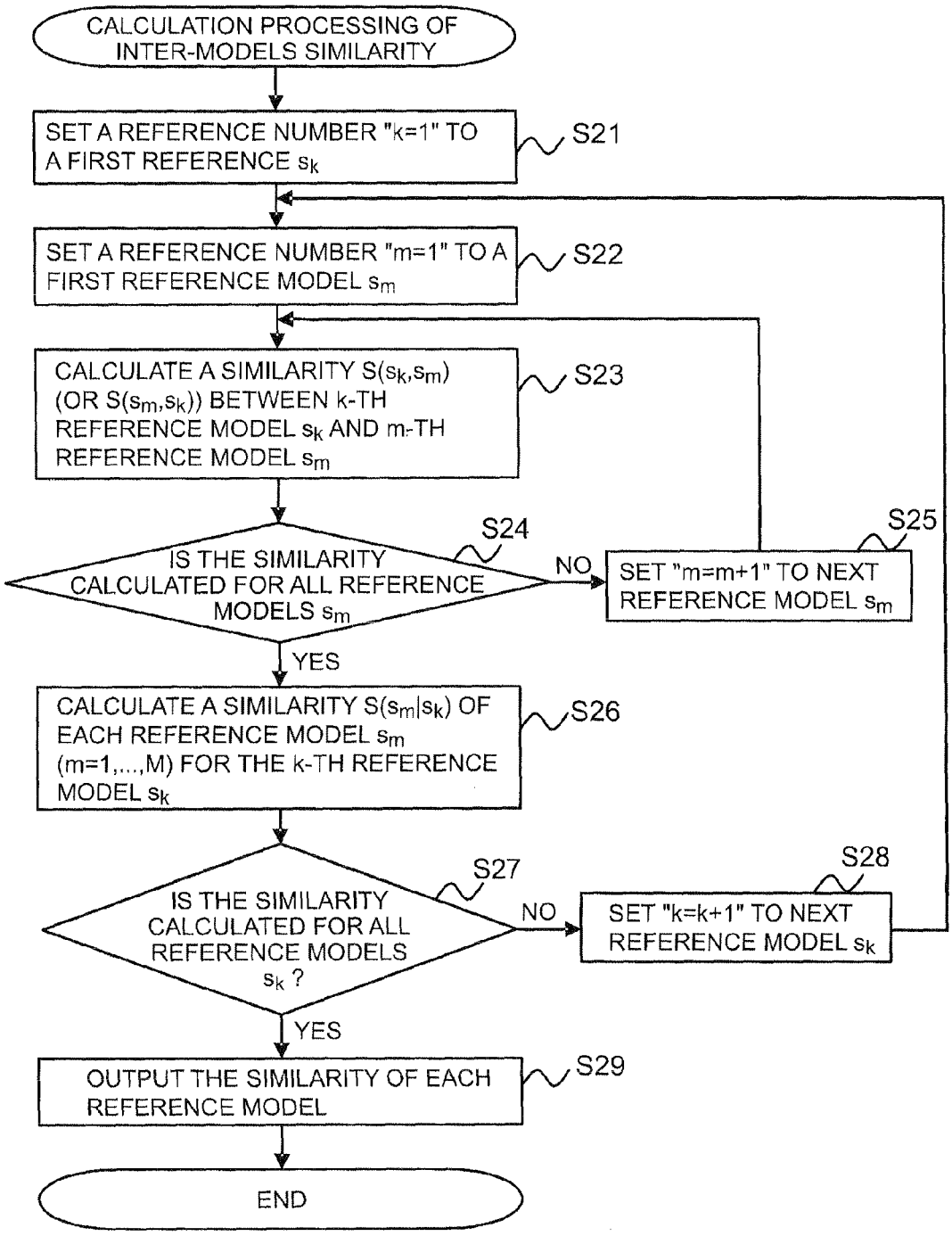
FIG. 7 is a flow chart of processing of an inter-models similarity calculation unit in FIG. 2.

Here, detail operation of the inter-models similarity calculation unit 14 is explained by referring to FIG. 7. FIG. 7 is a flow chart of processing of the inter-models similarity calculation unit 14.

First, the inter-models similarity calculation unit 14 sets a reference number "k=1" to a first reference model $s_k$ (S21). Next, the inter-models similarity calculation unit 14 sets a reference number "m=1" to a first reference model $s_m$ to be referred by the reference model $s_k$ (S22).

Next, the inter-models similarity calculation unit 14 calculates a similarity $S(s_k, s_m)$ between k-th reference model $s_k$ and m-th reference model $s_m$ (S23). For example, the similarity $S(s_k, s_m)$ is calculated by multiplying a Euclidean distance (using an averaged vector between two reference models) by minus (Refer to operation example O4 in FIG. 4B). The similarity $S(s_k, s_m)$ is equal to a similarity $S(s_m, s_k)$. Moreover, if the similarity $S(s_m, s_k)$ is already calculated, calculation processing of similarity $S(s_k, s_m)$ can be omitted.

Continually, the inter-models similarity calculation unit 14 decides whether the similarity between k-th reference model $s_k$ and all reference models $s_m$ is already calculated (S24). In this case, if the similarity between k-th reference model $s_k$ and at least one reference model $s_m$ is not calculated yet (No at S24), by setting the reference number "m=m+1", a next reference model $s_m$ is set as a processing target (S25), and processing is returned to S23.

On the other hand, if the similarity between k-th reference model $s_k$ and all reference models $s_m$ is already calculated (Yes at S24), a similarity $S(s_m|s_k)$ of each reference model $s_m$ for k-th reference model $s_k$ is calculated by using an equation (3). In order to calculate the similarity $S(s_m|s_k)$, an average "mean" and a standard deviation "sd" of all similarities for k-th reference model $s_k$, parameters "a, b" and a function "G", are used.

$$S(s_m \mid s_k) = G\left(a\left(\frac{S(s_k, s_m) - \text{mean}}{sd}\right) + b\right) \quad (3)$$

-continued $$G(x) = \begin{cases} H_1 & x \geq th1 \\ x & th1 > x > th2 \\ H_2 & x \leq th2 \end{cases} \quad (4)$$

First, the similarity $S(s_k, s_m)$ is normalized so that an average is "b" and a distribution is "$a^2$". In this case, an upper limit "$H_1$'" larger than the parameter "b" and smaller than (or equal to) an upper limit "$H_1$" is set. Furthermore, a lower limit "$H_2$'" smaller than the parameter "b" and larger than (or equal to) a lower limit "$H_2$" is set. The function "G" adjusts an input value (a normalized value of the similarity $S(s_k, s_m)$) to a value smaller than (or equal to) "$H_1$" and larger than (or equal to) "$H_1$'" if the input value is larger than (or equal to) a threshold th1. Furthermore, the function "G" adjusts the input value to a value larger than (or equal to) "$H_2$" and smaller than (or equal to) "$H_2$'" if the input value is smaller than (or equal to) a threshold th2. Furthermore, if two variables x and y have relationship "x>y", the function G has relationship "G(x)≥G(y)". The equation (4) represents an example of the function G assuming "$H_1$=$H_1$' and $H_2$=$H_2$'". Furthermore, in operation example of FIG. 4B, the similarity $S(s_m|s_k)$ is calculated by setting "a=2.0, b=0.5, $H_1$=1.0, $H_2$=0.0, th1=1.0, th2=0.0" (Refer to operation example O5 in FIG. 4B). Moreover, as the function G, various functions such as a sigmoid function can be applied.

Next, the inter-models similarity calculation unit 14 decides whether the similarity between all reference models $s_k$ and all reference models $s_m$ is already calculated (S27). In this case, if the similarity between at least one reference model $s_k$ and all reference models $s_m$ is not calculated yet (No at S27), by setting the reference number "k=k+1", a next reference model $s_k$ is set as a processing target (S28), and processing is returned to S22.

On the other hand, if the similarity between all reference models $s_k$ and all reference models $s_m$ is already calculated (Yes at S27), the similarity $S(s_m|s_k)$ between all reference models $s_k$ and all reference models $s_m$ is outputted to the second feature vector calculation unit 15 (S29), and processing is completed. In this way, the inter-models similarity calculation unit 14 outputs the similarity to the second feature vector calculation unit 15.

Next, by using the first feature vector (calculated at S105) and the similarity (calculated at S106), the second feature vector calculation unit 15 executes calculation processing of the second feature vector, and calculates the second feature vector of each segment (S107 in FIG. 3).

Figure 8:
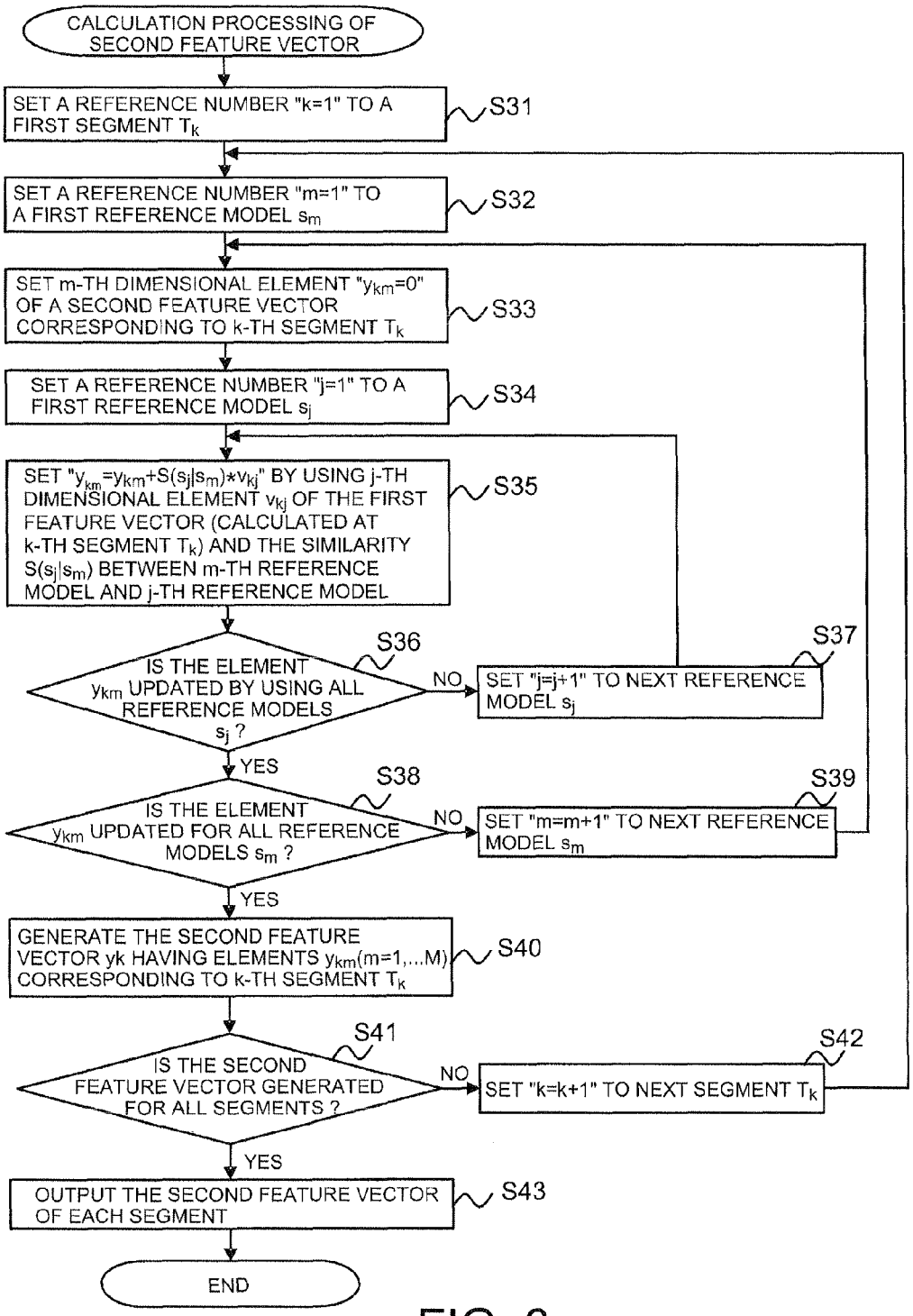
FIG. 8 is a flow chart of processing of a second feature vector calculation unit in FIG. 2.

Here, detail operation of the second feature vector calculation unit 15 is explained by referring to FIG. 8. FIG. 8 is a flow chart of processing of the second feature vector calculation unit 15.

First, the second feature vector calculation unit 15 sets a reference number "k=1" to a first segment $T_k$ (831). Next, the second feature vector calculation unit 15 sets a reference number "m=1" to a first reference model $s_m$ (S32). The step of S32 is processing to calculate m-th element (in a second feature vector) of k-th segment $T_k$.

Next, the second feature vector calculation unit 15 newly sets m-th dimensional element $y_{km}$ of the second feature vector corresponding to k-th segment $T_k$ (S33). Furthermore, the second feature vector calculation unit 15 sets a reference number "j=1" to a first reference model $s_{ji}$ to be referred by m-th reference model $s_m$ (S34).

Continually, by using j-th dimensional element $v_{kj}$ of the first feature vector $v_k$ (calculated at k-th segment $T_k$) and a similarity $S(s_j|s_m)$ between m-th reference model $s_m$ and j-th reference model $s_j$, the second feature vector calculation unit 15 updates the element $y_{km}$. Concretely, an equation "$y_{km}$=$y_{km}$+$S(s_j|s_m)$*$v_{kj}$" is set (S35).

Next, the second feature vector calculation unit 15 decides whether the similarity $S(s_j|s_m)$ between m-th reference model $s_m$ and all reference models $s_j$ is used to update the element $y_{km}$ (S36). In this case, if the similarity between m-th reference model $s_m$ and at least one reference model $s_j$ is not used yet (No at S36), by setting the reference number "j=j+1", a next reference model $s_j$ is set as a processing target (S37), and processing is returned to S35.

On the other hand, if the similarity between m-th reference model $s_m$ and all reference models $s_j$ is already used (Yes at S36), the second feature vector calculation unit 15 decides whether all elements of M-dimension (M: the number of reference models) are updated in the second feature vector corresponding to k-th segment $T_k$ (S38). In this case, if at least one element of M-dimension is not updated in the second feature vector (No at S38), by setting the reference number "m=m+1", a next reference model $s_m$ is set as a processing target (S39), and processing is returned to S33.

Figure 4B:
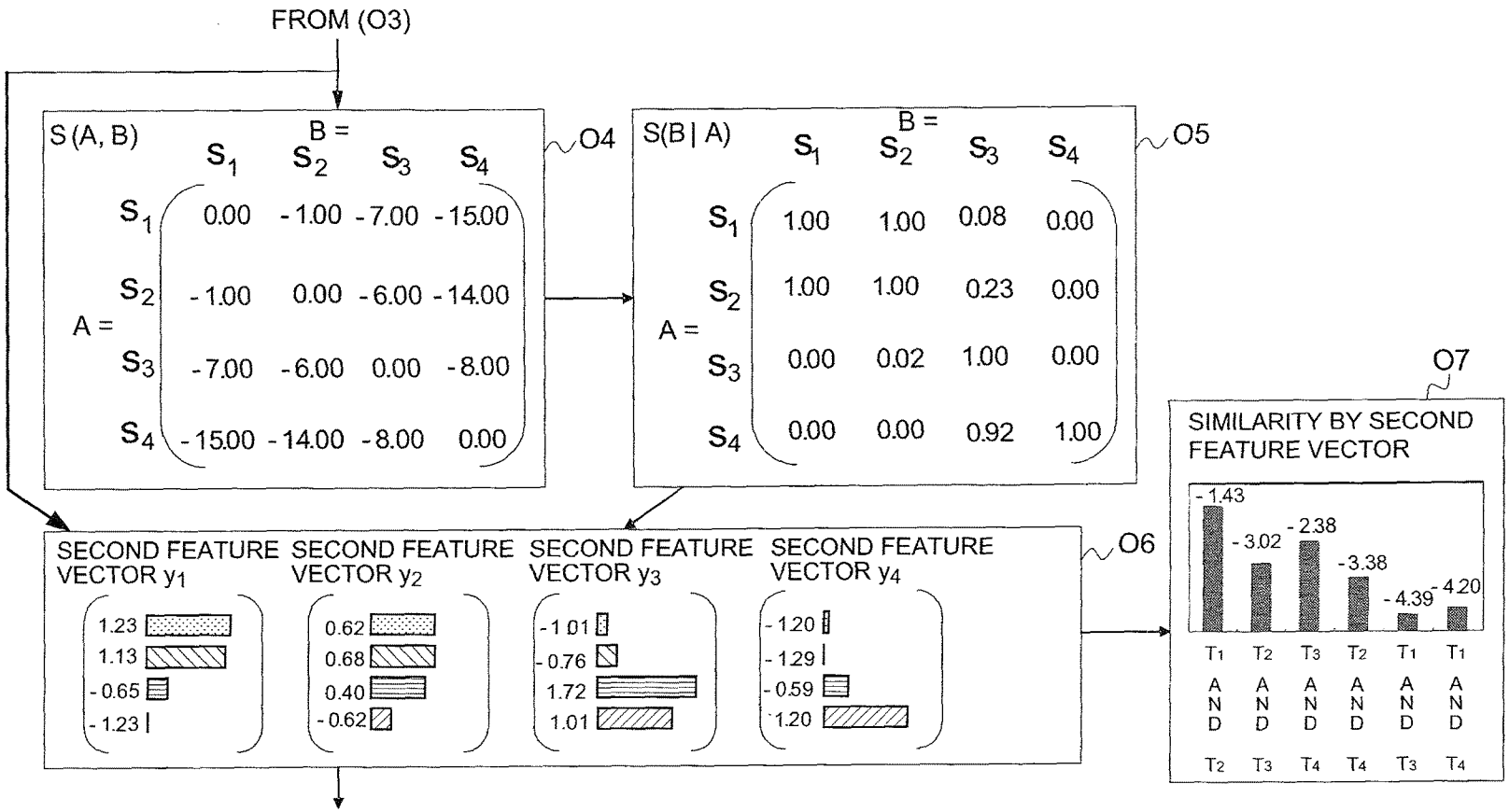

On the other hand, if all elements of M-dimension is already updated in the second feature vector corresponding to k-th segment $T_k$ (Yes at S38), a second feature vector $y_k$ having all updated elements is generated (S40). In FIG. 4B, after information of operation example O5 in FIG. 4B is acquired, by using information of operation example O3 in FIG. 4A, the second feature vector is generated (Refer to operation example O6 in FIG. 4B).

Next, the second feature vector calculation unit 15 decides whether the second feature vector $y_k$ is already generated for all segments (S41). In this case, if the second feature vector $y_k$ is not generated for at least one segment (No at S41), by setting the reference number "k=k+1", a next segment $T_k$ set as a processing target, and processing is returned to S32.

On the other hand, if the second feature vector $y_k$ is already generated for all segments (Yes at S41), the second feature vector $y_k$ of each segment and time information thereof are outputted to the clustering unit 16 (S43), and processing is completed. In this way, the second feature vector calculation unit 15 outputs the second feature vector to the clustering unit 16.

Next, among all second feature vectors calculated at S107, the clustering unit 16 clusters second feature vectors having similar feature as one class, and assigns the same ID to all segments corresponding to the second feature vectors belonging to the one class (S108). Then, processing is completed.

Here, as to processing of the clustering unit 16, in FIG. 4B, operation to assign the same ID is not shown. However, a multiplied value of a Euclidean distance between two vectors by minus is shown as a similarity (Refer to operation example O7 in FIG. 4B). In FIGS. 4A and 4B, reference models $s_1$ and $s_2$ represent a specific scene. In order to assign the same ID to segments $T_1$ and $T_2$ belonging to distribution of reference models $s_1$ and $s_2$ respectively, a similarity between two segments $T_1$ and $T_2$ must be higher than a similarity between two segments of all other pairs. In a situation that first feature vectors $v_1$ and $v_2$ has differently a high likelihood for only one of scenes $s_1$ and $s_2$ (Refer to operation example O3 in FIG. 4A), it is difficult to heighten a similarity between segments $T_1$ and $T_2$ and assign the same ID (as scenes $s_1$ and $s_2$) thereto (Refer to operation example O7' in FIG. 4A). On the other hand, in the first embodiment, by considering a similarity between two reference models, a high likelihood of a second feature vector for one reference model is reflected to a low likelihood of another second feature vector for another reference model having a high similarity with the one reference model (Refer to operation model O6 in FIG. 4B). As a result, the similarity between two segments $T_1$ and $T_2$ becomes high, and the same ID (as two scenes $s_1$ and $s_2$) can be assigned to two segments T1 and T2 (Refer to operation example O7 in FIG. 4B).

Figure 9A:
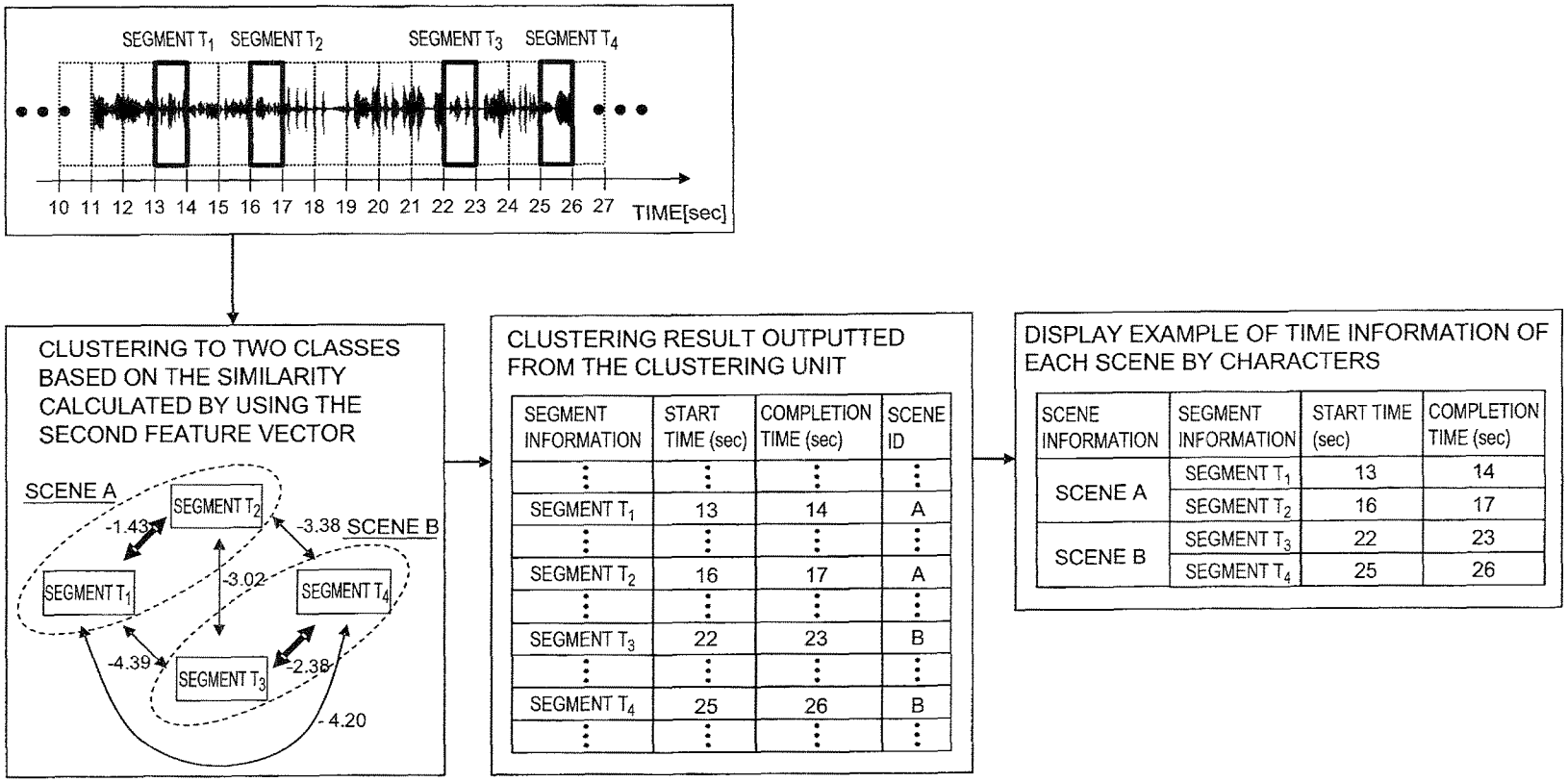
FIGS. 9A and 9B are clustering examples based on a similarity calculated by using second and first feature vectors respectively.
Figure 9B:
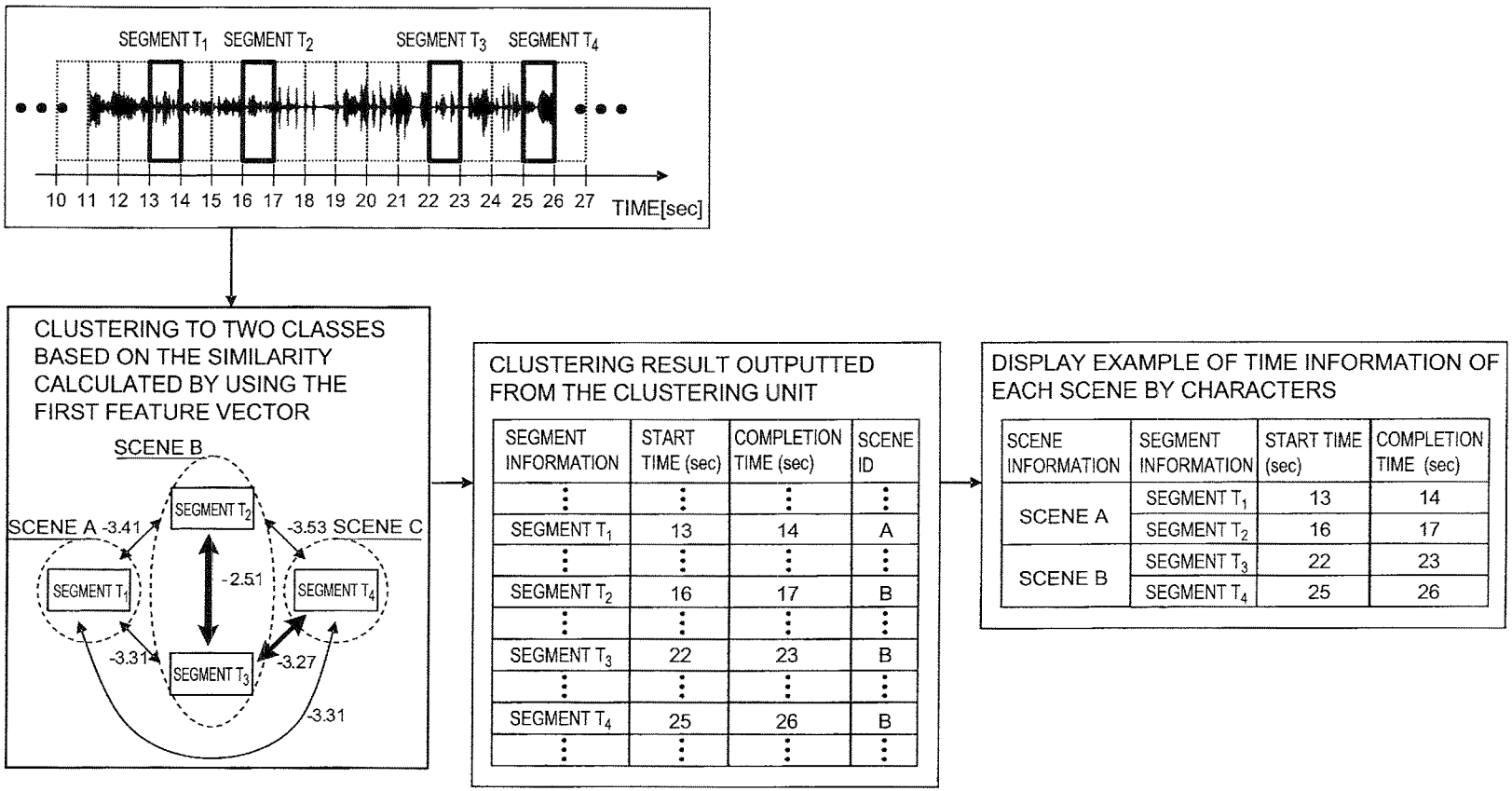

FIG. 9A is an example of clustering to two classes based on similarity shown in operation example O7 in FIG. 4B. FIG. 9B is an example of clustering by using the first feature vector only for the same acoustic signal as FIG. 9A.

As shown in FIG. 9A, in case of using the second feature vector of the first embodiment, by mutually considering the similarity between two of four segments $T_1$, $T_2$, $T_3$ and $T_4$, two segments $T_1$ and $T_2$ having the highest similarity (shown by a thick arrow line), and two segments $T_3$ and $T_4$ having the second highest similarity (shown by a thick arrow line), can be clustered to the same class respectively. As a result, four segments $T_1$, $T_2$, $T_3$ and $T_4$ are clustered to two classes. Furthermore, one class represents one scene. Accordingly, the same ID as scene is assigned to two segments $T_1$ and $T_2$, and two segments $T_3$ and $T_4$, respectively. As a result, as shown in the right side of FIG. 9A, time information can be displayed. This display operation is explained afterwards.

On the other hand, in FIG. 9B, in case of using the first feature vector only, by mutually considering the similarity between two of four segments $T_1$, $T_2$, $T_3$ and $T_4$, three segments $T_1$, $T_2$ and $T_3$ having the highest similarity and the second highest similarity (each shown by a thick arrow line) can be clustered to the same class. As a result, four segments $T_1$, $T_2$, $T_3$ and $T_4$ are clustered to two classes. As mentioned-above, it is desirable that the same ID is assigned to two segments $T_1$ and $T_2$. However, in comparison with a similarity between two segments $T_2$ and $T_3$ (or two segments $T_3$ and $T_4$), a similarity between two segments $T_1$ and $T_2$ is lower. Accordingly, in case of using the first feature vector, the same ID cannot be assigned to two segments $T_1$ and $T_2$.

As mentioned-above, in the first embodiment, even if a segment (divided acoustic signal) does not have a high likelihood for all reference models (each representing a specific scene), by considering a similarity between two reference models, a high likelihood of the second feature vector for one reference model is reflected to a low likelihood of another second feature vector for another reference model having a high similarity with the one reference model. As a result, the segment can be clustered to the specific scene corresponding thereto.

The Second Embodiment

Figure 10:
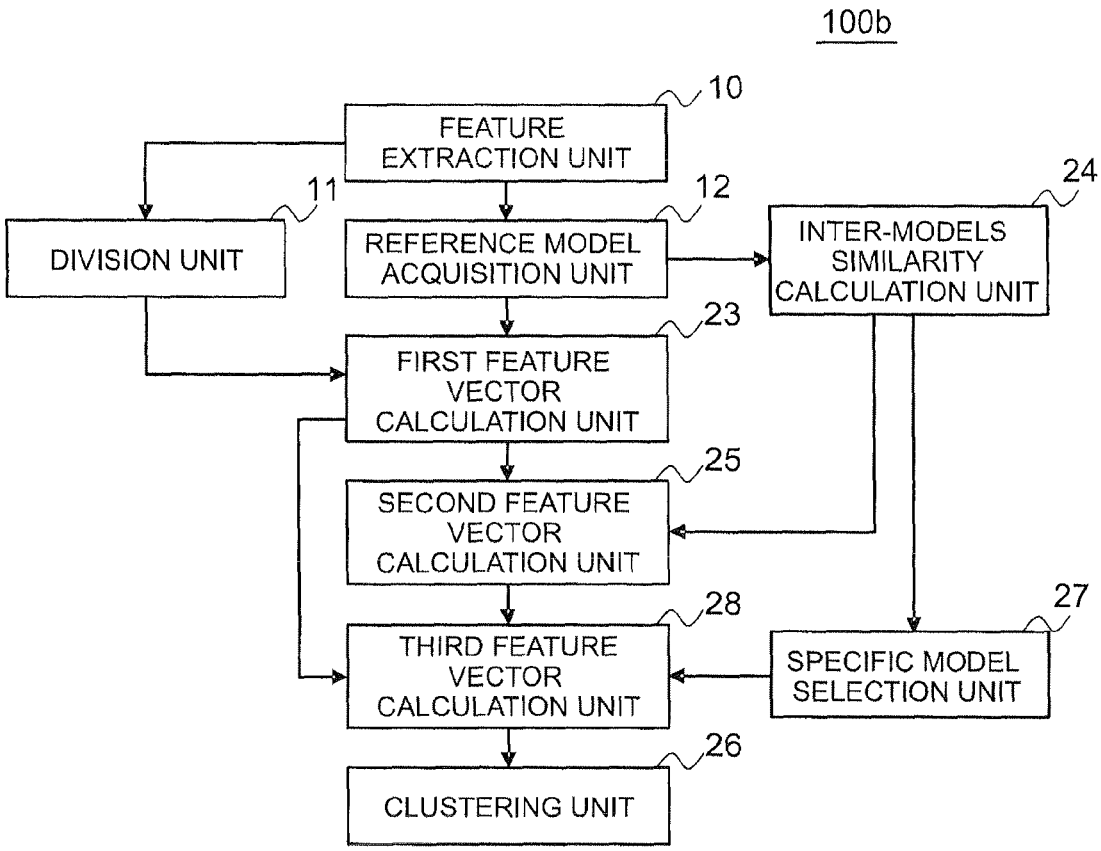
FIG. 10 is a block diagram of functional component of the signal clustering apparatus according to the second embodiment.

Next, a signal clustering apparatus 100*b* according to the second embodiment is explained. FIG. 10 is a block diagram of functional component 100*b* of the signal clustering apparatus. In the second embodiment, in comparison with the first embodiment, a specific model selection unit 27 and a third feature vector calculation unit 28 are added. Accordingly, function of the specific model selection unit 27 and the third feature vector calculation unit 28 is mainly explained. As to the same unit in the first embodiment, the same name is assigned, and its explanation is omitted.

As shown in FIG. 10, the signal clustering apparatus 100*b* includes the feature extraction unit 10, the division unit 11, the reference model acquisition unit 12, a first feature vector calculation unit 23, an inter-models similarity calculation unit 24, a second feature vector calculation unit 25, a specific model selection unit 27, a third feature vector calculation unit 28, and a clustering unit 26.

Moreover, in FIG. 10, the first feature vector calculation unit 23, the inter-models similarity calculation unit 24, the second feature vector calculation unit 25, the specific model selection unit 27, the third feature vector calculation unit 28 and the clustering unit 26, are functional units realized by cooperating with a predetermined program previously stored in the CPU 101 and the ROM 104, in the same way as the feature extraction unit 10, the division unit 11 and the reference model acquisition unit 12.

The first feature vector calculation unit 23 outputs the first feature vector of each segment and time information thereof to the third feature vector calculation unit 28. The inter-models similarity calculation unit 24 outputs the similarity to the second feature vector calculation unit 25 and the specific model selection unit 27. Furthermore, the second feature vector calculation unit 25 outputs the second feature vector of each segment and time information thereof to the third feature vector calculation unit 28.

By using the second feature vector of each segment (inputted from the second feature vector calculation unit 25), the first feature vector of each segment (inputted from the first feature vector calculation unit 23) and a specific model (inputted from the specific model selection unit 27), the third feature vector calculation unit 28 calculates a third feature vector peculiar to each segment. Furthermore, the third feature vector calculation unit 28 outputs the third feature vector of each segment and time information thereof to the clustering unit 26.

Next, the specific model selection unit 27 is explained. By using the similarity inputted from the inter-models similarity calculation unit 24, the specific model selection unit 27 calculates a specific score of each reference model based on a similarity between the reference model and each of all reference models. Then, the specific model selection unit 27 compares the specific model of each reference model mutually, and selects at least one reference model as a specific model. Furthermore, the specific model selection unit 27 outputs the specific model and a correspondence relationship between the reference model and the specific model to the third feature vector calculation unit 28.

Figure 11:
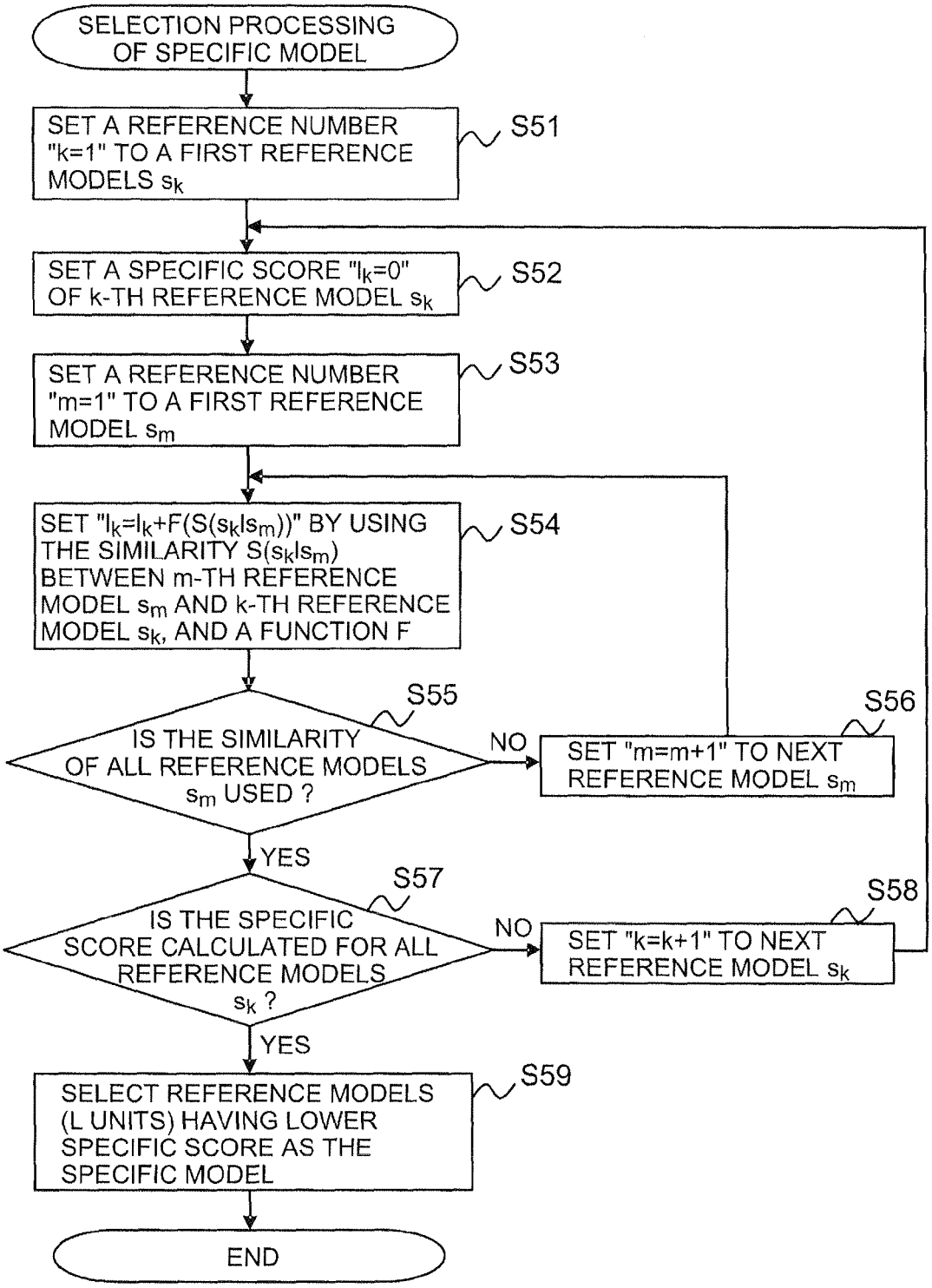
FIG. 11 is a flow chart of processing of a specific model selection unit in FIG. 10.

Hereinafter, operation of the specific model selection unit 27 is explained by referring to FIG. 11. FIG. 11 is a flow chart of processing of the specific model selection unit 27.

First, the specific model selection unit 27 sets a reference number "k=1" to a first reference model $s_k$ to calculate a specific score for selecting a specific model (S51).

Next, the specific model selection unit 27 sets a specific score "$l_k$=0" of k-th reference model $s_k$ (S52). Furthermore, the specific model selection unit 27 sets a reference number "m=1" to a first reference model $s_m$ to be referred by the reference model $s_k$ (S53).

Continually, the specific model selection unit 27 sets a specific score "$l_k=l_k+F(S(s_k|_m))$" by using the similarity $S(s_k|s_m)$ between k-th reference model $s_k$ and the reference model $s_m$, and a function F represented by an equation (5).

$$F(x) = \begin{cases} 1 & x \geq 1 \\ 0 & x < 1 \end{cases} \tag{5}$$

In this case, if two variables x and y have a relationship "x>y", the function F represents "F(x)≥F(y)". Furthermore, for example, the function F is set as "F(x)=x".

Next, the specific model selection unit 27 decides whether the similarity between k-th reference model $s_k$ and each of all reference models $s_m$ is used for calculating a specific score of the k-th reference model $s_k$ (S55). In this case, if the similarity between k-th reference model $s_k$ and at least one reference models $s_m$ is not used yet (No at S55), by setting the reference number "m=m+1", a next reference model $s_m$ is set as a processing target (S56), and processing is returned to 554.

On the other hand, if the similarity between k-th reference model $s_k$ and each of all reference models $s_m$ is already used (Yes at S55), the specific model selection unit 27 decides whether the specific score is already calculated for all reference models $s_k$ (S57). In this case, if the specific score is not calculated for at least one reference model $s_k$ (No at S57), by setting the reference number "k=k+1", a next reference model $s_k$ is set as a processing target (S58), and processing is returned to S52.

Figure 4C:
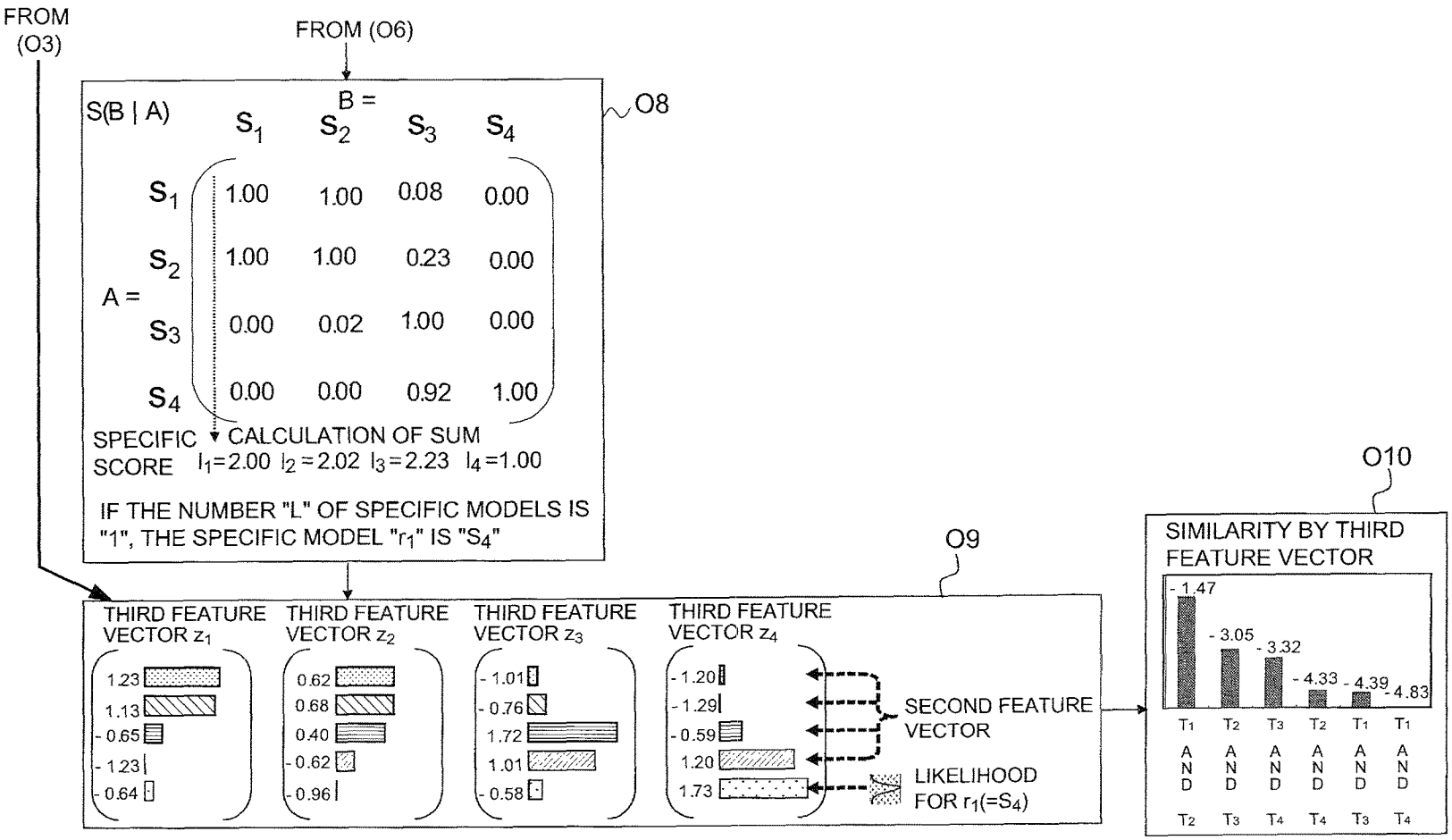

On the other hand, if the specific score is already calculated for all reference models $s_k$ (Yes at S57), the specific model selection unit 27 selects reference models (of L units) having the lower specific score as a specific model, and outputs the specific model and information of the reference model corresponding to the specific model to the third feature vector calculation unit 28 (S59). Then, processing is completed. Moreover, "L" is a parameter. In FIG. 4C, by using "L=1" and the equation (5), the reference model $s_4$ is selected as the specific model $r_1$ (Refer to operation example O8 in FIG. 4C).

Figure 12:
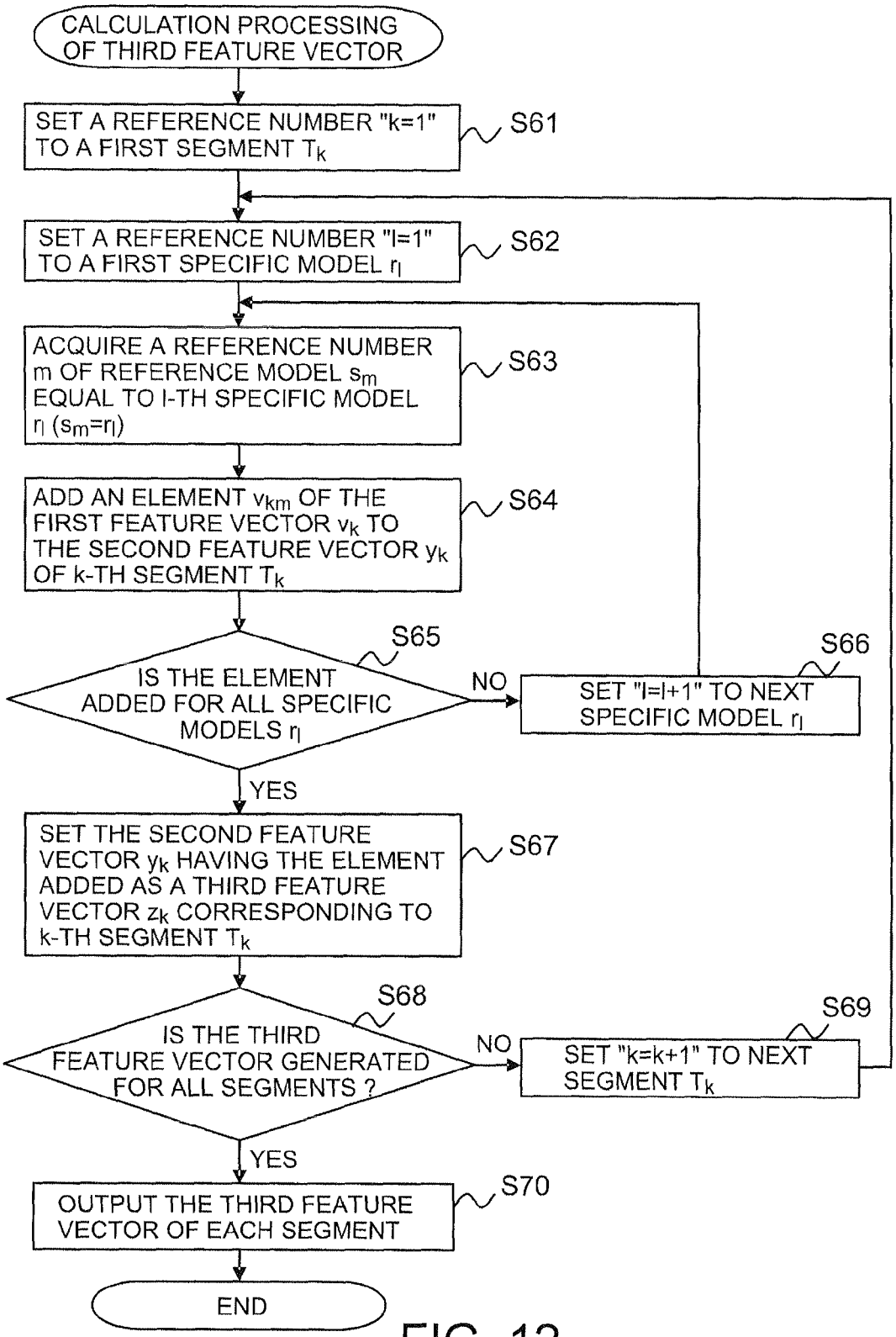
FIG. 12 is a flow chart of processing of a third feature vector calculation unit in FIG. 10.

Next, the third feature vector calculation unit 28 is explained. By using the second feature vector of each segment, the first feature vector of each segment and the specific model, the third feature vector calculation unit 28 calculates a third feature vector peculiar to each segment. FIG. 12 is a flow chart of processing of the third feature vector calculation unit 28.

First, the third feature vector calculation unit 28 sets a reference number "k=1" to a first segment $T_k$ (S61). Furthermore, the third feature vector calculation unit 28 sets a reference number "l=1" to a first specific model $r_1$ (S62).

Next, the third feature vector calculation unit 28 acquires a reference number "m" of the reference model corresponding (equal) to l-th specific model $r_1$ (S63).

Continually, the third feature vector calculation unit 28 adds m-th element $v_{km}$ of the first feature vector $v_k$ as (M+1)-th new element to the second feature vector $y_k$ calculated at k-th segment $T_k$ (S64).

Next, the third feature vector calculation unit 28 decides whether the element $v_{km}$ of the first feature vector $v_k$ corresponding to all specific models $r_1$ is already added to the second feature vector $y_k$ calculated at k-th segment $T_k$ (S65). In this case, if the element $v_{km}$ of the first feature vector $v_k$ corresponding to at least one specific model $r_1$ is not added yet (No at S65), by setting the reference number "l=l+1", a next specific model $r_1$ is set as a processing target (S66), and processing is returned to S63.

On the other hand, if the element $v_{km}$ of the first feature vector $v_k$ corresponding to all specific models $r_1$ is already added (Yes at S65), the second feature vector $y_k$ (corresponding to k-th segment $T_k$) to which the element $v_{km}$ is added is a third feature vector $Z_k$ (S67). In FIGS. 4A~4C, after information of operation example O8 in FIG. 4C is acquired, by using information of operation examples O3 in FIG. 4A and O6 in FIG. 4B, the third feature vector is acquired (Refer to operation O9 in FIG. 4C).

Next, the third feature vector calculation unit 28 decides whether the third feature vector is already generated for all segments (S68). In this case, if the third feature vector is not generated for at least one segment yet (No at 68), by referring to the reference number "k=k+1", a next segment $T_k$ is set as a processing target (S69), and processing is returned to S62.

On the other hand, if the third feature vector is already generated for all segment (Yes at 68), the third feature vector calculation unit 28 outputs the third feature vector of each segment and time information thereof to the clustering unit 26 (S70). Then, processing is completed. In this way, after outputting the third feature vector of each segment and time information to the clustering unit 26, the third feature vector calculation unit 28 completes operation thereof.

Next, among third feature vectors of all segments (inputted from the third feature vector calculation unit 15), the clustering unit 26 clusters third feature vectors having similar feature as one class. Furthermore, the clustering unit 26 assigns the same ID (class number) to each segment corresponding to the third feature vectors belonging to the one class.

Figure 13A:
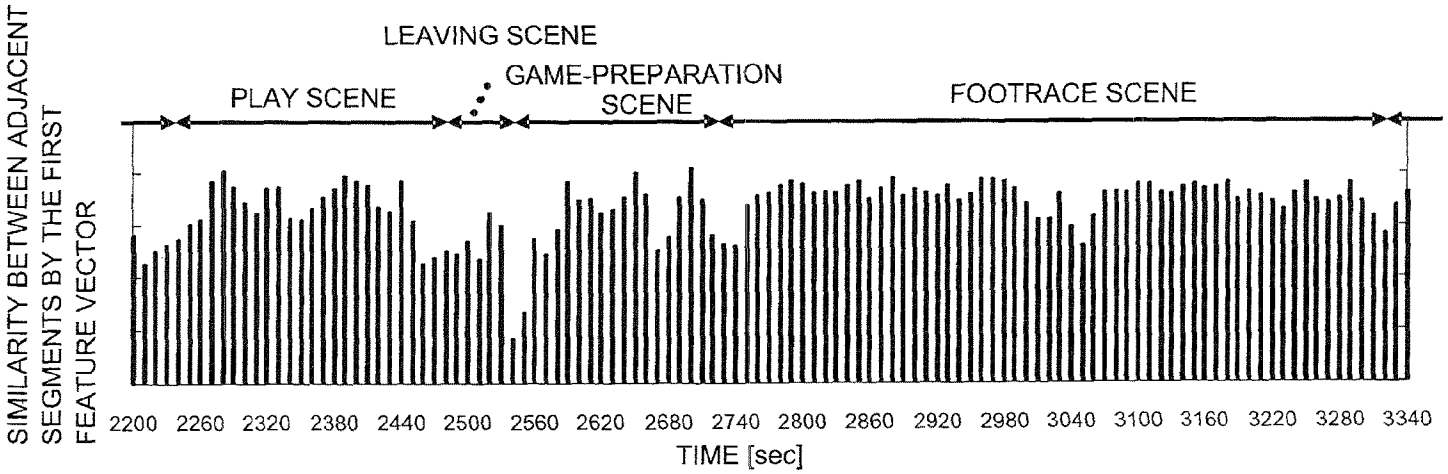
FIGS. 13A and 13B are examples of similarity between adjacent segments by using the first and third feature vectors respectively.
Figure 13B:
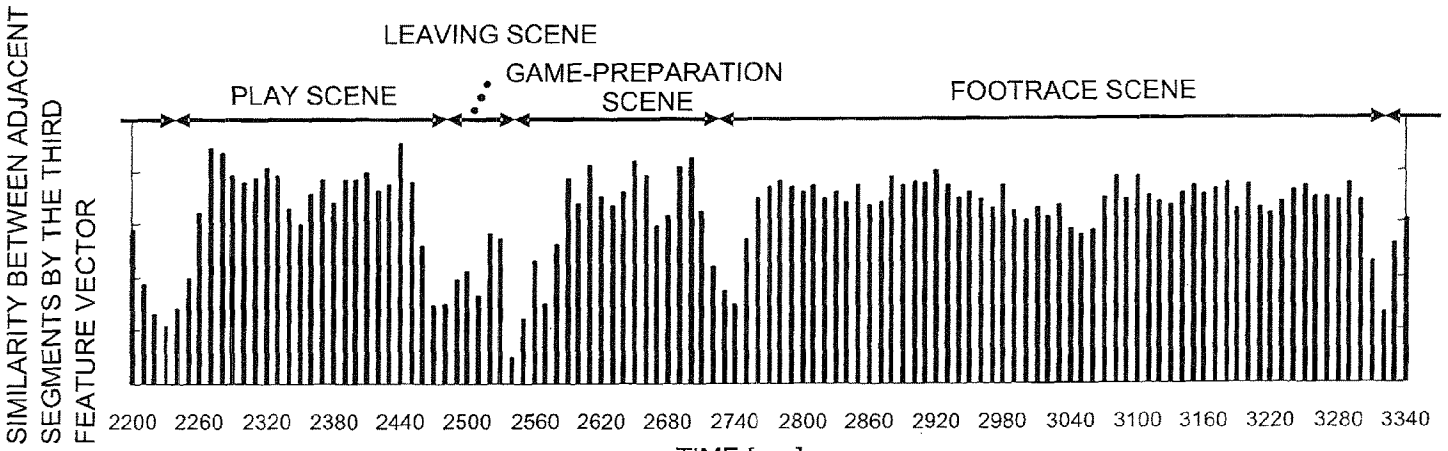

FIG. 13 shows one example of processing result of acoustic signal acquired by photographing an athletic meeting via a video camera. Especially, FIG. 13A shows a similarity (calculated by using the first feature vector) between two adjacent segments at each time. FIG. 13B shows a similarity (calculated by using the third feature vector) between two adjacent segments at each time.

As shown in FIG. 13A, in case of using the first feature vector, a low similarity cannot be sufficiently acquired before and after several scenes (for example, a play scene, a footrace scene). On the other hand, as shown in FIG. 13B, in case of using the third feature vector (calculated by the inter-models similarity), a low similarity can be acquired at a boundary of each scene (between a play scene and a leaving scene, between a leaving scene and a game-preparation scene, between a game-preparation scene and a footrace scene). Accordingly, in case of using the third feature vector, each scene can be easily detected.

Figure 14:
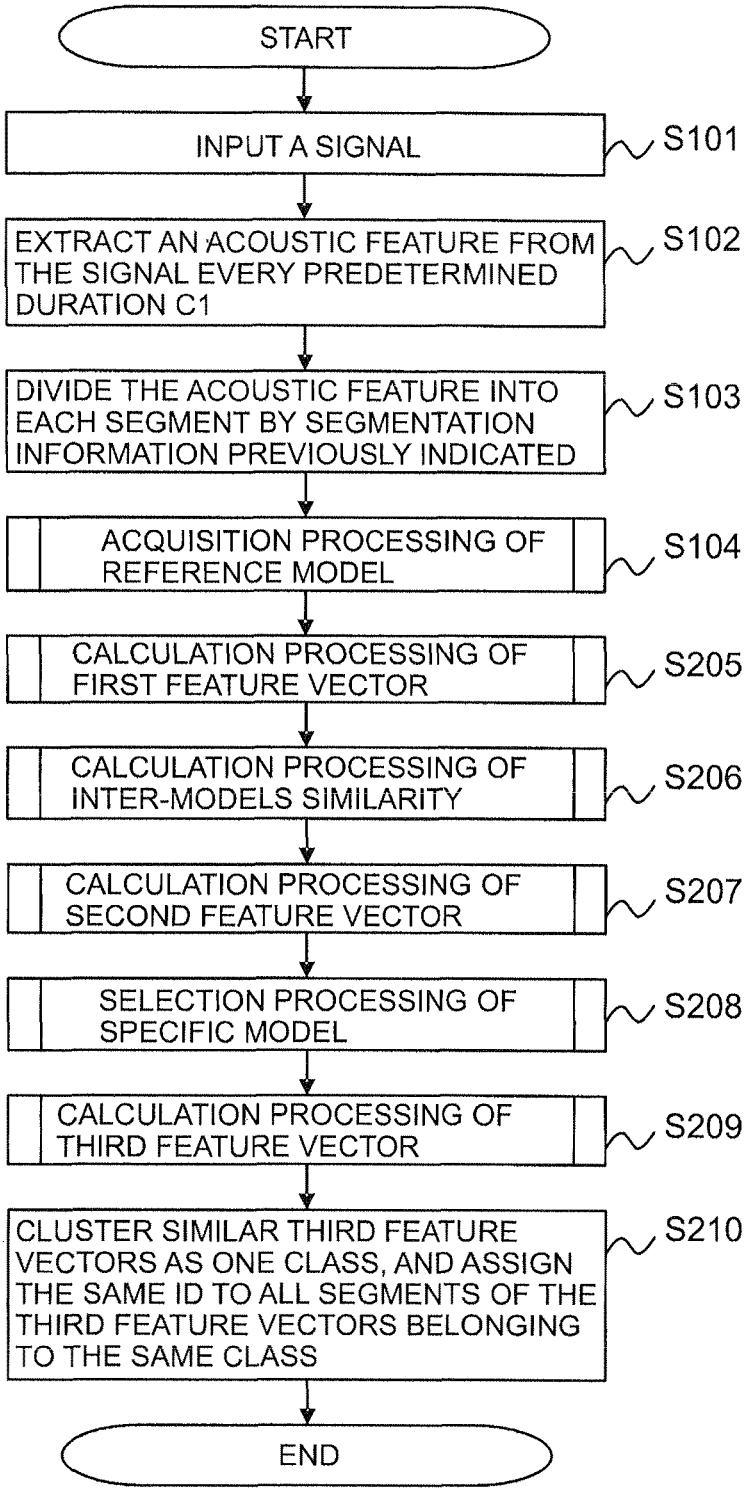
FIG. 14 is a flow chart of processing of the signal clustering apparatus according to the second embodiment.

FIG. 14 is a flow chart of processing of the signal clustering apparatus 100*b* according to the second embodiment. Hereinafter, by referring to FIG. 14 and operation examples O1~O10 in FIGS. 4A-4C, signal clustering processing of the second embodiment is explained.

First, at S101~S104, the same processing as S101~S104 is executed (Refer to operation examples O1 and O2 in FIG. 14A).

Continually, by using the reference model (acquired at S104 in FIG. 14) and the acoustic feature of each segment, the first feature vector calculation unit 23 executes calculation processing of first feature vector, and calculates a first feature vector of each segment (S205, refer to operation example O3 in FIG. 4A). The first feature vector calculation unit 23 outputs the first feature vector to the second feature vector calculation unit 25 and the third feature vector calculation unit 28.

Next, by using the reference model (acquired at S104), the inter-models similarity calculation unit 24 executes calculation processing of inter-models similarity, and calculates a similarity between each reference model and all reference models (S206, refer to operation examples O4 and O5 in FIG. 4B). The inter-models similarity calculation unit 24 outputs the similarity to the second feature vector calculation unit 25 and the specific model selection unit 27.

Next, by using the first feature vector (calculated S205) and the similarity (calculated at S206), the second feature vector calculation unit 25 executes calculation processing of second feature vector, and calculates a second feature vector of each segment (S207, refer to operation example O6 in FIG. 4B). The second feature vector calculation unit 25 outputs the second feature vector to the third feature vector calculation unit 28.

Next, by using the similarity (calculated at S206), the specific model selection unit 27 executes selection processing of specific model, and selects at least one specific model (S208, refer to operation example O8 in FIG. 4C). The specific model selection unit 27 outputs the specific model to the third feature vector calculation unit 28.

Next, by using the second feature vector (calculated at S207), the first feature vector (calculated at S205) and the specific model (selected at S208), the third feature vector calculation unit 28 executes calculation processing of third feature vector, and calculates a third feature vector of each segment (S209, refer to operation example O9 in FIG. 4C). The third feature vector calculation unit 28 outputs the third feature vector to the clustering unit 26.

Last, among all third feature vectors calculated at S209, the clustering unit 26 clusters third feature vectors having similar feature as one class, and assigns the same ID to all segments corresponding to the third feature vectors belonging to one class (S210). Then, processing is completed.

In explanation of operation examples in FIGS. 4A and 4B (the first embodiment), reference models $s_1$ and $s_2$ represent a specific scene. In the second embodiment, as shown in FIG. 4C, the reference model $s_3$ further represents the same specific scene. An average of the reference model $s_3$ is nearer an average of the reference models $s_1$ and $s_2$ than an average of the reference model $s_4$. Accordingly, a situation that the reference model $s_3$ also represents the same specific scene can be occurred. In this case, the reference model $s_4$ only represents another scene, and the specific scene represented by many reference models and another scene represented by few reference models exist. In order for a segment $T_3$ (belonging to distribution of the reference model $s_3$) to acquire the same ID as a segment $T_2$ (belonging to distribution of the reference model $s_2$), a similarity between segments $T_2$ and $T_3$ must be higher than a similarity between segment $T_3$ and $T_4$ (belonging to another scene). Under a situation that the second feature vector is used, another scene represented by the reference model $s_4$ becomes unnoticeable. AS a result, it is difficult that the same ID is assigned to segments $T_2$ and $T_3$ and an ID of another scene is differently assigned to the segment $T_4$ (Refer to operation example O7 in FIG. 4B).

On the other hand, in the second embodiment, the reference model $s_4$ representing another scene (the number of reference models is few) is selected as a specific model. Furthermore, a third feature vector is calculated by adding an element (corresponding to the specific model) of the first feature vector, and the ID is assigned to each segment by using the third feature vector. As a result, a similarity between segments $T_2$ and $T_3$ heightens, and the same ID (as the specific scene) is assigned to segments $T_2$ and $T_3$. Furthermore, a different ID (as another scene) is assigned to the segment $T_4$ (Refer to operation example O10 in FIG. 4C).

Figure 15:
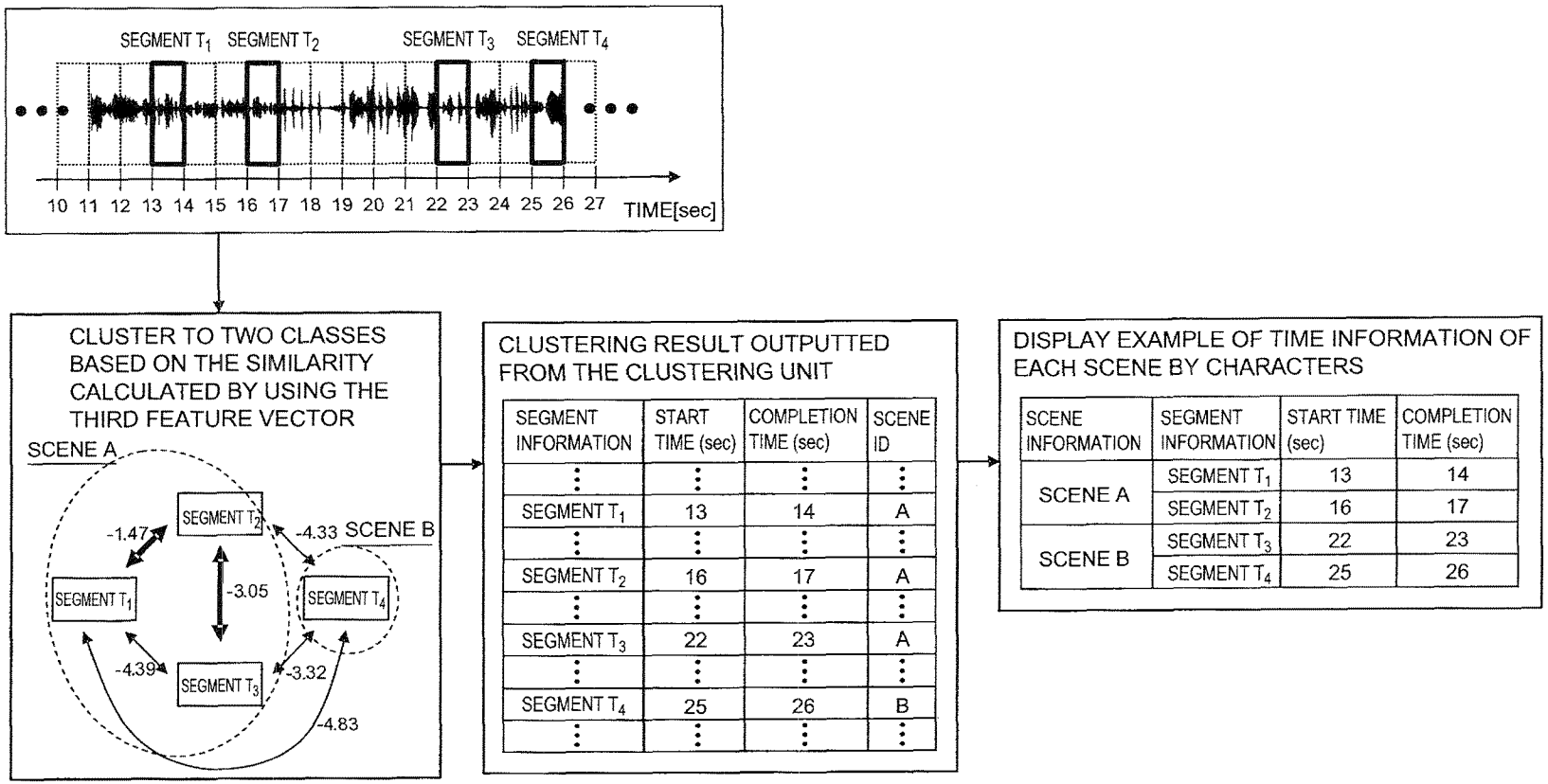
FIG. 15 is a clustering example based on a similarity calculated by using the third feature vector.

FIG. 15 is an example of clustering to two classes based on a similarity shown in operation example O10 in FIG. 4C. In case of using the third feature vector, by mutually comparing the similarity between two of four segments $T_1$, $T_2$, $T_3$ and $T_4$, segments $T_1$ and $T_2$ having the highest similarity (shown by a thick arrow line), and segments $T_2$ and $T_3$ having the second highest similarity (shown by a thick arrow line), are clustered to the same class. Briefly, four segments $T_1$, $T_2$, $T_3$ and $T_4$ are clustered to two classes. Accordingly, the same ID is assigned to three segments $T_1$, $T_2$ and $T_3$. As a result, time information shown in the right side of FIG. 15 can be displayed.

As mentioned-above, as to the second embodiment, in a situation that a short scene (the number of reference models is few) is unnoticeable by clustering to a long scene (the number of reference models is many), a reference model representing the short scene is selected as the specific model, and a feature of the short scene is taken into consideration. As a result, the short scene can be detected. Furthermore, by adding a likelihood of the reference model representing the short scene, information of the short scene is emphasized, and miss of detection of the short scene is avoided.

The Third Embodiment

Figure 16:
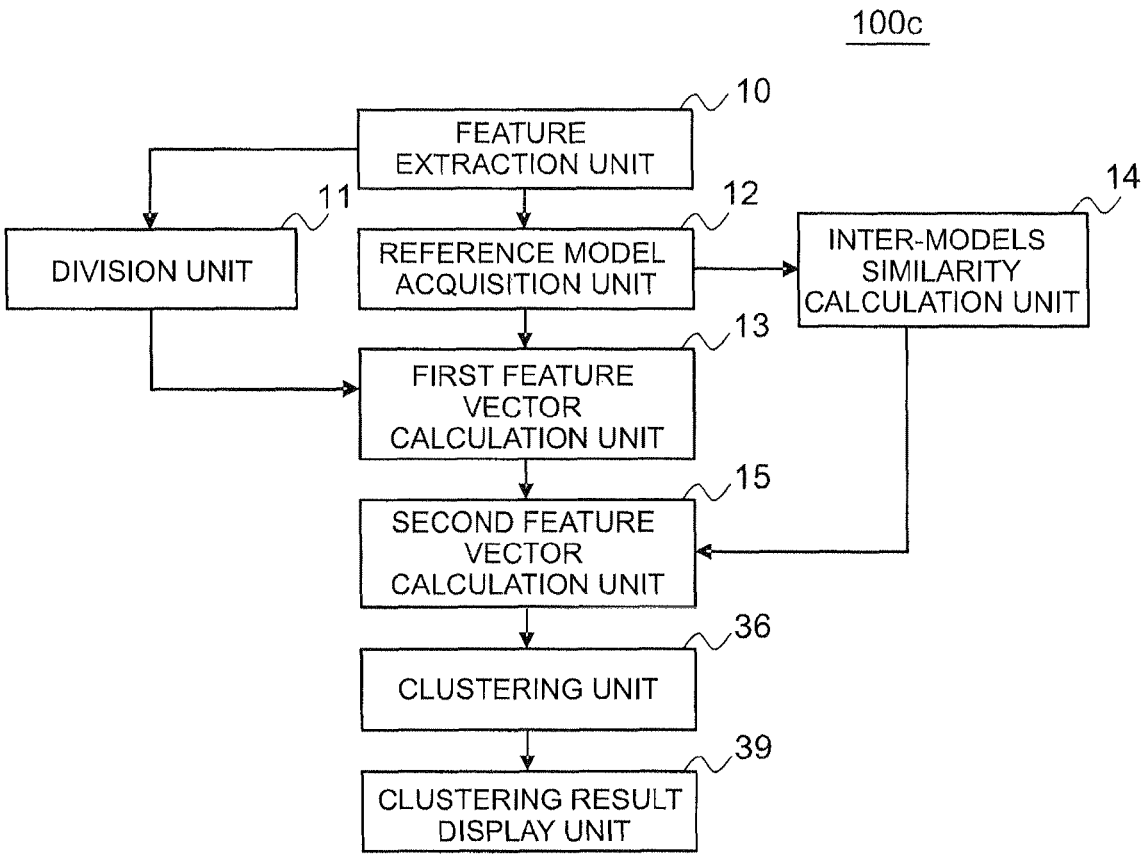
FIG. 16 is a block diagram of functional component of the signal clustering apparatus according to a third embodiment.

Next, a signal clustering apparatus 100*c* according to the third embodiment is explained. FIG. 16 is a block diagram of functional component of the signal clustering apparatus 100*c*. In the third embodiment, in comparison with the first embodiment, a clustering result display unit 39 is added. Accordingly, function of the clustering result display unit 39 is mainly explained. As to the same unit in the first embodiment, the same name is assigned, and its explanation is omitted.

As shown in FIG. 16, the signal clustering apparatus 100*c* includes the feature extraction unit 10, the division unit 11, the reference model acquisition unit 12, the first feature vector calculation unit 13, the inter-models similarity calculation unit 14, the second feature vector calculation unit 15, a clustering unit 36, and a clustering result display unit 39.

Moreover, in FIG. 16, the clustering unit 36 and the clustering result display unit 39 are functional units realized by cooperating with a predetermined program previously stored in the CPU 101 and the ROM 104, in the same way as the feature extraction unit 10, the division unit 11, the first feature vector calculation unit 13, the inter-models similarity calculation unit 14 and the second feature vector calculation unit 15.

The clustering unit 36 outputs ID information of each segment and time information thereof to the clustering result display unit 39.

Based on the ID information (inputted from the clustering unit 36), the clustering result display unit 39 displays scene information (such as characters or picture) of each time or time information of each scene via the display unit 103. Moreover, segments having the same ID belong to the same scene, and continuous segments having the same ID are one clustered segments.

Figure 17:
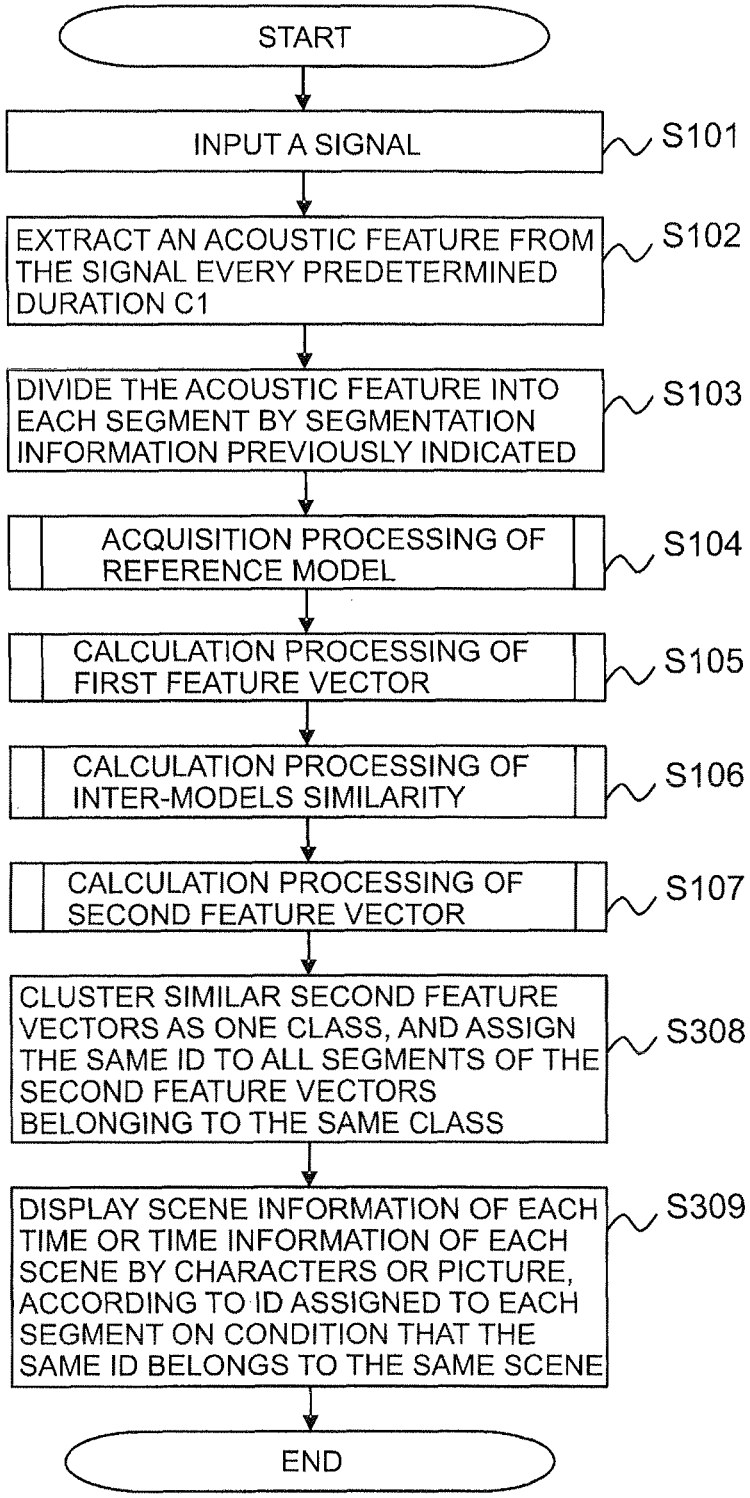
FIG. 17 is a flow chart of processing of the signal clustering apparatus according to the third embodiment.

FIG. 17 is a flow chart of the signal clustering apparatus 100*c* according to the third embodiment. Hereinafter, by referring to FIGS. 16~18, signal clustering-processing of the third embodiment is explained. Moreover, FIG. 18 is a display example of clustering result by the clustering result display unit 39.

First, at S101~S107 in FIG. 16, same processing as S101~S107 in FIG. 3 is executed (Refer to operation examples O1~O6 in FIGS. 4A and 4B).

Continually, among all second feature vectors calculated at S107, the clustering unit 36 clusters second feature vectors having similar feature as one class, and assigns the same ID to all segments corresponding to the second feature vectors belonging to the one class (S308). Furthermore, the clustering unit 36 outputs ID information of each segment to the clustering result display unit 39.

Based on the ID of each segment (assigned at S308), the clustering result display unit 39 displays scene information (such as characters or picture) of each time or time information of each scene via the display unit 103 (S309). Then, processing is completed.

In FIG. 18, a block at the left side is a display example of clustering result (outputted from the clustering unit 36) processed by the clustering result display unit 39. In correspondence with ID of each scene, start time and completion time are recorded. An upper block at the right side is a display example of time information of each scene (extracted from the block at the left side). A middle block at the right side is a display example of scene information and time information of each segment (extracted from the block at the left side). A lower block at the right side is a display example of scene information of each time (extracted from the block at the left side) by a time bar.

As mentioned-above, in the third embodiment, after segments (divided acoustic signal) are clustered as each scene, the clustering result is displayed. Accordingly, in case of viewing/listening a video/speech (corresponding to the segments), by setting an utterance, an event or a scene as one unit, an access to a specific time (such as a skip-replay) can be easily performed.

Moreover, the signal clustering processing according to the first, second and third embodiments may be realized by previously installing a program into a computer. Furthermore, after the program is stored into a storage medium (such as a CD-ROM) or the program is distributed via a network, the signal clustering processing may be realized by suitably installing the program into the computer.

While certain embodiments have been described, these embodiments have been presented by way of examples only, and are not intended to limit the scope of the inventions. Indeed, the novel apparatuses and methods described herein may be embodied in a variety of other forms; furthermore, various omissions, substitutions and changes in the form of the apparatuses and methods described herein may be made without departing from the spirit of the inventions. The accompanying claims and their equivalents are intended to cover such forms or modifications as would fall within the scope and spirit of the inventions.

What is claimed is:

1. A signal clustering apparatus comprising:

a feature extraction unit configured to extract a feature having a distribution from a signal;

a division unit configured to divide the feature into segments by a predetermined duration;

a reference model acquisition unit configured to acquire a plurality of reference models, each reference model representing a specific feature having a distribution;

a first feature vector calculation unit configured to calculate a first feature vector of each segment by comparing each segment with the plurality of reference models, the first feature vector having a plurality of elements corresponding to each reference model, a value of an element attenuating when a divided feature of the segment shifting from a center of the distribution of the specific feature of the reference model corresponding to the element;

an inter-models similarity calculation unit configured to calculate a similarity between two reference models as all pairs selected from the plurality of reference models;

a second feature vector calculation unit configured to calculate a second feature vector of each segment, the second feature vector having a plurality of elements corresponding to each reference model, a value of an element of the second feature being a weighted sum by multiplying each element of the first feature vector of the same segment by the similarity between each reference model and the reference model corresponding to the element; and a clustering unit configured to cluster segments corresponding to second feature vectors of which the plurality of elements are similar values to one class.

2. The apparatus according to claim 1, wherein the reference model acquisition unit divides the feature into each pre-segment by a duration longer than the predetermined duration, generates a pre-model of each pre-segment based on a divided feature of the pre-segment, sets a plurality of adjacent pre-segments to one region, calculates a similarity of each region based on pre-models of the pre-segments included in the region, extracts a region having the similarity higher than a threshold as a training region, and generates a reference model of the training region based on the feature included in the training region.

3. The apparatus according to claim 1, further comprising:

a specific model selection unit configured to calculate a score of each reference model based on the similarity between the reference model and each reference model, and to select at least one reference model as a specific model by comparing the score of each reference model; and a third feature vector calculation unit configured to calculate a third feature vector of each segment, the third feature vector having the plurality of elements of the second feature vector of the same segment and an element corresponding to the at least one reference model in the first feature vector of the same segment;

wherein the clustering unit clusters segments of third feature vectors of which the plurality of elements and the element are similar values to one class.

4. The apparatus according to claim 1, further comprising:

a clustering result display unit configured to display a clustering result of each segment of the signal based on the clustering result by the clustering result.

* * * * *